US005253176A

United States Patent [19]

Todoroki et al.

[11] Patent Number: 5,253,176

[45] Date of Patent: Oct. 12, 1993

[54] APPARATUS AND METHOD FOR PRODUCING VARIABLE CONFIGURATION DIE

[75] Inventors: Masaaki Todoroki, Machida; Hidetoshi Imazu, Sagamihara; Hideo Nomura; Nobuyuki Yamaguchi, both of Yokohama; Junichi Asano, Zama; Kenji Ishibashi, Yamato; Koichi Yamamoto, Yokohama, all of Japan

[73] Assignee: Nissan Motor Co., Ltd., Yokohama, Japan

[21] Appl. No.: 687,483

[22] Filed: Apr. 19, 1991

[30] Foreign Application Priority Data

| | | | |
|---|---|---|---|
| Apr. 19, 1990 | [JP] | Japan | 2-103631 |
| May 18, 1990 | [JP] | Japan | 2-128692 |
| May 21, 1990 | [JP] | Japan | 2-131030 |
| May 23, 1990 | [JP] | Japan | 2-132899 |

[51] Int. Cl.[5] ..... G06F 15/46; B21K 5/20

[52] U.S. Cl. ..... 364/468; 364/478; 76/107.1

[58] Field of Search ..... 364/468, 469, 472, 473, 364/478, 476; 76/107.1; 72/7; 264/241, 259

[56] References Cited

U.S. PATENT DOCUMENTS

| | | | |
|---|---|---|---|
| 4,835,450 | 5/1989 | Suzuki | 318/568.13 |
| 5,031,483 | 7/1991 | Weaver | 76/107.1 |

FOREIGN PATENT DOCUMENTS

| | | |
|---|---|---|
| 3210588 | 10/1983 | Fed. Rep. of Germany . |
| 250875 | 10/1987 | Fed. Rep. of Germany . |
| 56-36343 | 4/1981 | Japan . |
| 61-47217 | 3/1986 | Japan . |
| 61-276741 | 12/1986 | Japan . |
| 596403 | 1/1948 | United Kingdom . |
| 1269932 | 4/1972 | United Kingdom . |
| 2118079 | 10/1983 | United Kingdom . |

OTHER PUBLICATIONS

D. Hardt, M. Chadoury and M. Domroese, "Flexible Automation and Robotics Program", pp. 15–19, date unknown.

*Primary Examiner*—Jerry Smith
*Assistant Examiner*—Paul Gordon
*Attorney, Agent, or Firm*—Foley & Lardner

[57] ABSTRACT

An apparatus for producing a variable configuration die by using a plurality of pins is disclosed. The apparatus comprises a pin storing device for storing the pins therein; a pin piling device in which the variable configuration die is to be produced; a robot device for transferring the pins from the pin storing device to the pin piling device for making up the variable configuration die; and a computer-aided control device for controlling the robot means in such a manner that the pins carried by the robot means are placed onto given positions of the pin piling device to cause the variable configuration die thus made of the piled pins in the pin piling device to have a layered structure. The variable configuration die thus made up has a recessed die surface which is defined by one ends of the piled pins.

27 Claims, 25 Drawing Sheets

APPARATUS AND METHOD FOR PRODUCING VARIABLE CONFIGURATION DIE

BACKGROUND OF THE INVENTION

1. Field of the Invention

The present invention relates in general to an apparatus and a method for producing variable configuration dies which are used for producing casted metal dies and/or molded plastic dies of small lots, and more particularly, to an apparatus and a method for producing the variable configuration dies by using a plurality of metal pins.

2. Description of the Prior Art

Sheet metal parts with compound curvative shapes are typically produced by deforming the sheet metal between A pair of metal dies. Owing to variations in sheet metal material properties, however, such dies require substantial development time.

In order to reduce or eliminate such die development time, there have been hitherto proposed several measures which create a sheet metal forming process that is capable of producing small lots without prohibitive tooling costs. Some of them are described in Japanese Patent First Provisional Publications Nos. 56-36343 and 61-47217.

In the measure disclosed by these publications, a plurality of metal pins are used for producing a variable configuration die. That is, the pins are parallelly arranged and piled in a manner to form a discrete recessed die surface with their one ends. For forming the recessed die surface, some of the piled pins are axially displaced with respect to the remaining piled pins. After the piled pins are tightly bound to produce a fixed variable configuration die, the same is so arranged that the recessed die surface faces upward. Then, a melted metal is casted into the recess of the die. After the metal is cooled, the same is removed from the die. With this, a casted metal die having a convex die surface is produced.

In the process of producing the variable configuration die, the displacement of the pins is achieved by an ultrasonic vibration shifting means or the like.

However, this pin shifting method has the following drawback.

That is, during the axial movement of the selected pins by the shifting means, it tends to occur that neighboring pins of the selected pins are inevitably drawn by the same due to frictional forces produced therebetween. This phenomenon causes lowering in configuration accuracy of the shaped discrete die surface.

In order to eliminate this drawback, Japanese Patent First Provisional Publication 61-276741 proposes a measure in which certain clearances are provided between neighboring pins. Due to provision of such clearances, the undesired pin drawing phenomenon does not occur. However, also in this case, the discrete die surface produced becomes rough due to provision of marked blanks on the die surface.

SUMMARY OF THE INVENTION

It is therefore an object of the present invention to provide an apparatus and a method for producing variable configuration dies, which are free of the above-mentioned drawbacks.

According to a first aspect of the present invention, there is provided an apparatus for producing a variable configuration die by using a plurality of pins, which comprises a pin storing device for storing the pins therein; a pin piling device in which the variable configuration die is to be produced; robot means for transferring the pins from the pin storing device to the pin piling device for making up the variable configuration die; and a computer-aided control device for controlling the robot means in such a manner that the pins carried by the robot means are placed onto given positions of the pin piling device to cause the variable configuration die thus made of the piled pins in the pin piling device to have a layered structure, the variable configuration die thus made up having a recessed die surface which is defined by one ends of the piled pins.

According to a second aspect of the present invention, there is provided a method of producing a variable configuration die by using a plurality of identical pins, which comprises by steps (a) storing the pins in a pin storing device and preparing a pin piling device; (b) analyzing an imaginary metal casted die, which is to be produced by the variable configuration die, to prepare various data which represent the shape of the metal casted die; (c) transferring the pins from the pin storing device to given positions of the pin piling device in a manner to make up the variable configuration die by the pins in accordance with informations based on the data.

BRIEF DESCRIPTION OF THE DRAWINGS

Other objects and advantages of the present invention will become apparent from the following description when taken in conjunction with the accompanying drawings, in which.

DETAILED DESCRIPTION OF THE EMBODIMENTS

Figure 1:
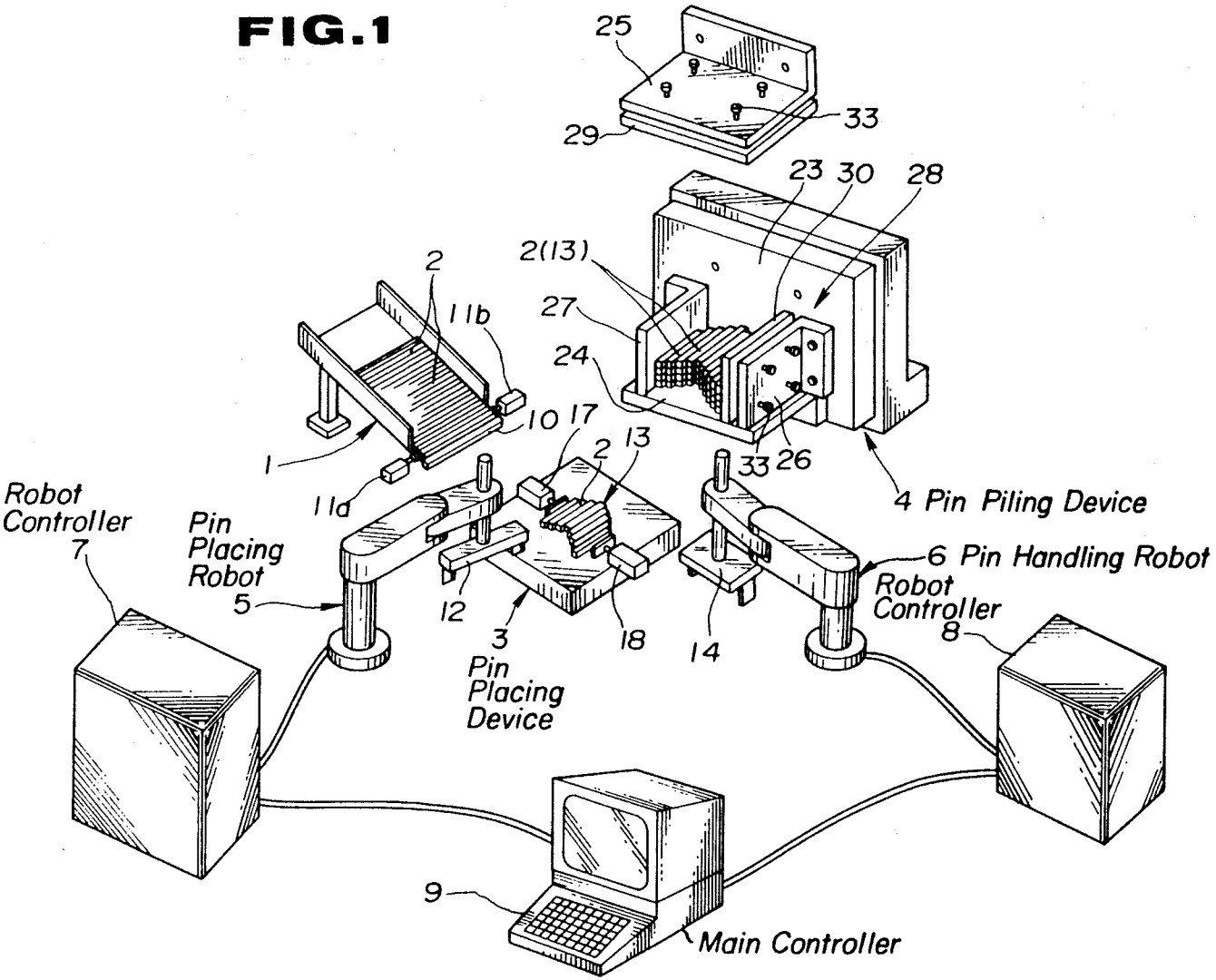
FIG. 1 is a perspective view of an apparatus of a first embodiment of the present invention.
Figure 2:
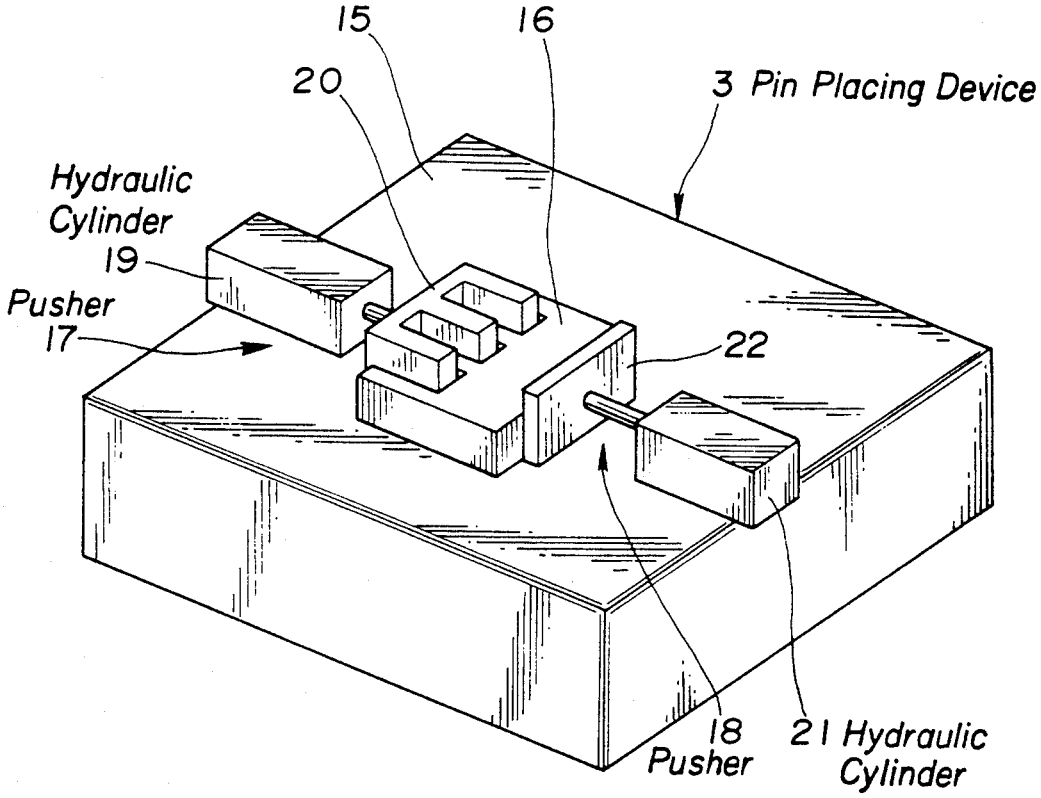
FIG. 2 is a perspective view of a pin placing device employed in the first embodiment.

Referring to FIGS. 1 to 11, particularly FIG. 1, there is shown an apparatus of a first embodiment of the present invention.

In FIG. 1, denoted by numeral 1 is a magazine in which a plurality of rectangular metal pins 2 are received. Denoted by numeral 3 is a pin placing device, 4 is a pin piling device, 5 is a pin placing robot, 6 is a pin handling robot, 7 and 8 are robot controllers and 9 is a main controller which has a computer.

The magazine 1 has a bottom floor somewhat inclined and has at its downstream side a pin stopper 10 and a pair of.-pin pushers 11*a* and 11*b*. Due to works of the pin stopper 10 and the pin pushers 11*a* and 11*b*, the pins 2 in the magazine 1 are discharged therefrom one after another at given intervals. The discharged pins 2 are picked up, one after another, by a manipulator hand 12 of the pin placing robot 5 and placed onto predetermined positions of a pin carrying surface (no numeral) of the pin placing device 3.

When the pins 2 on the pin carrying surface are increased to a predetermined number, they (viz., a group 13 of pins 2) are picked up in a lump by a manipulator hand 14 of the pin handling robot 6 and placed onto a predetermined position of a pin carrying surface (no numeral) of the pin piling device 4.

Figure 4:
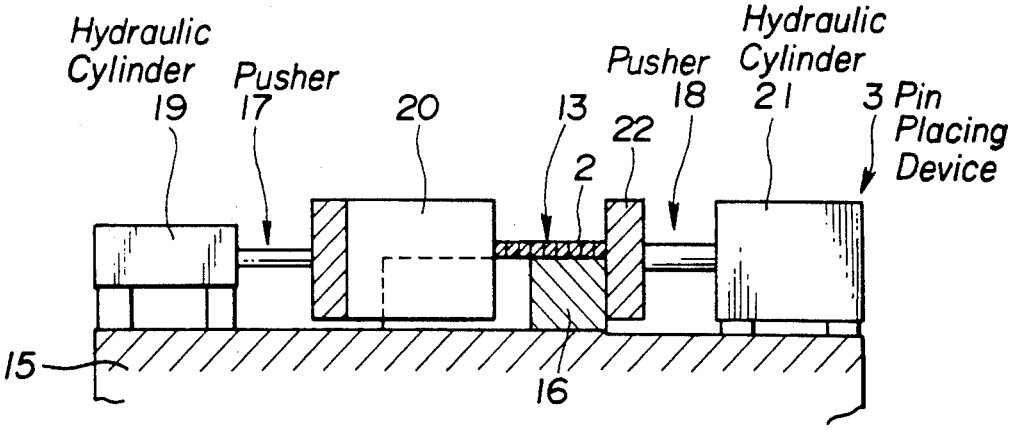
FIG. 4 is a sectional view taken along the line IV—IV of FIG. 3.

As is well shown in FIG. 4, the pin placing device 3 comprises a flat board member 16 mounted on a base body 15. A pair of pushers 17 and 18 are arranged on the base body 15 in a manner to put therebetween the flat board member 16. The pusher 17 includes a hydraulic cylinder 19 and a forked hand member 20 axially driven by the cylinder 19, and the other pusher 18 includes a hydraulic cylinder 21 and a flat hand member 22 axially driven by the cylinder 21. The cylinder 21 has a power greater than that of the cylinder 19. The flat board member 16 has three grooves (no numerals) into which the forks of the hand member 20 are insertable.

Figure 3:
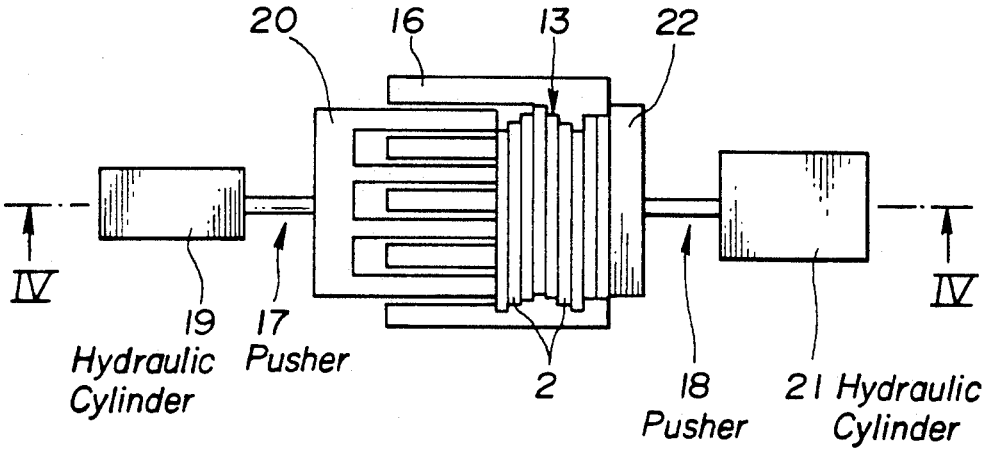
FIG. 3 is a plan view of the pin placing device with some pins placed thereon.

As will be understood from FIGS. 3 and 4, when a predetermined number of the pins 2 are placed on the flat board member 16 by the pin placing robot 5, the flat hand member 22 is advanced to one side surface of the flat board member 16 and at the same time the forked hand member 20 is inserted into the grooves of the board member 16 thereby to tightly sandwich the grouped pins 2 therebetween.

As is seen from FIG. 3, the grouped pins 2 (which will be referred to as "pin group" 13 in the following for ease of description) are arranged to form, by their one ends, a part of an after-mentioned discrete die surface.

Receiving instruction signals from the robot controller 7, the pin placing robot 5 is so operated that the subsequent pin group 13 prepared on the pin placing device 3 is different in shape from the previous pin group 13 which has been set in the pin piling device 4.

Figure 5:
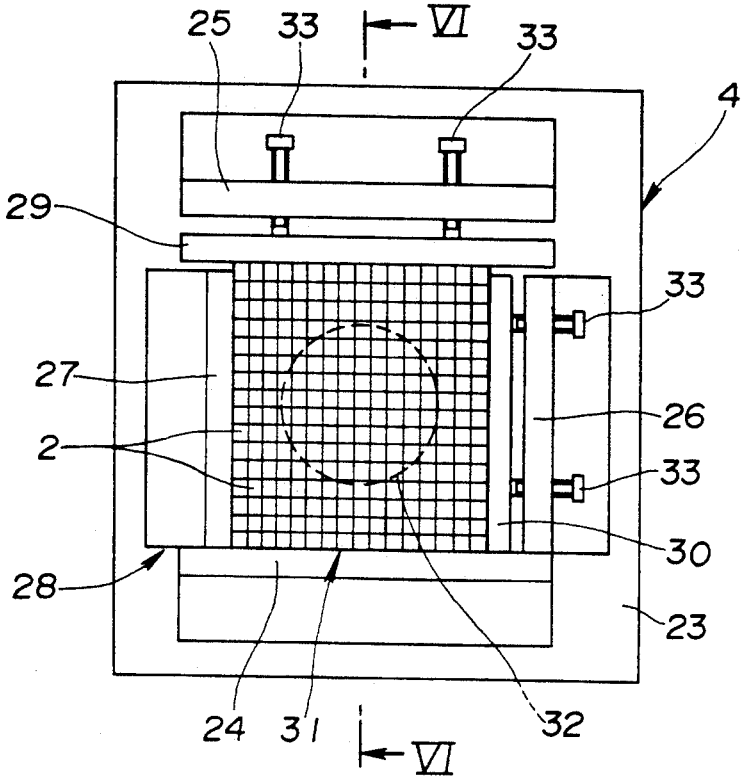
FIG. 5 is a front view of a pin piling device employed in the first embodiment, the device being shown with full of pins.

As is seen from FIG. 1 and 5, the pin piling device 4 comprises a vertical base board 23 and four flat wall members 24, 25, 26 and 27. The four wall members 24, 25, 26 and 27 are arranged on the vertical base board 23 in a manner to constitute a rectangular frame structure 28 as is seen from FIG. 5. Under pin piling process, the upper wall member 25 is kept away from the base board 23 as shown in FIG. 1.

As is seen from FIG. 5, the upper wall member 25 and the side wall member 26 have each a movable press plate 29 or 30 carried thereby through four bolts 33.

By the manipulator hand 14 of the pin handling robot 6, the pin group 13 on the pin placing device 3 is transferred and placed onto the inner surface of the lower wall member 24 between the side wall member 27 and the movable press plate 30. Subsequent pin groups 13 are placed on the previous pin group 13 one after another.

Receiving instruction signals from the robot controller 8, the pin handling robot 6 is so operated that subsequent pin groups 13 are placed or piled on given portions of the previous pin groups 13 one after another.

Figure 6:
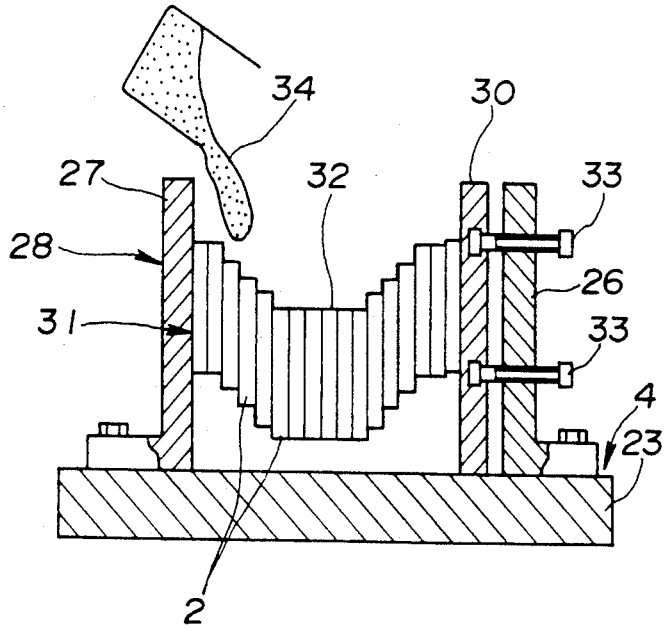
FIG. 6 is a sectional view taken along the line V—V of FIG. 5.

Thus, by repeating the above-mentioned pin placing and piling operations by predetermined times, there becomes produced a recessed block 31 of the piled pins 2 within the frame structure 28 of the pin piling device 4, as will be understood from FIGS. 5 and 6. After this, the upper wall member 25 is bolted to the vertical base board 23 to complete the frame structure 28. Then, the respective bolts 33 of the upper wall member 25 and those of the side wall member 26 are manipulated to press the corresponding press plates 29 and 30 against the upper and side surfaces of the recessed block 31. With these steps, as will be seen from FIG. 5, a so-called "variable configuration die" 31 having a discrete die surface 32 is produced. The discrete die surface 32 is defined by one ends of the piled pins 2.

Then, as will be understood from FIG. 6, the pin piling device 4 is raised up together with the fixed die 31 so that the recessed die surface 32 of the die 31 faces upward, and melted metal 34 is casted into the fecess 32 of the die 31.

Figure 7:
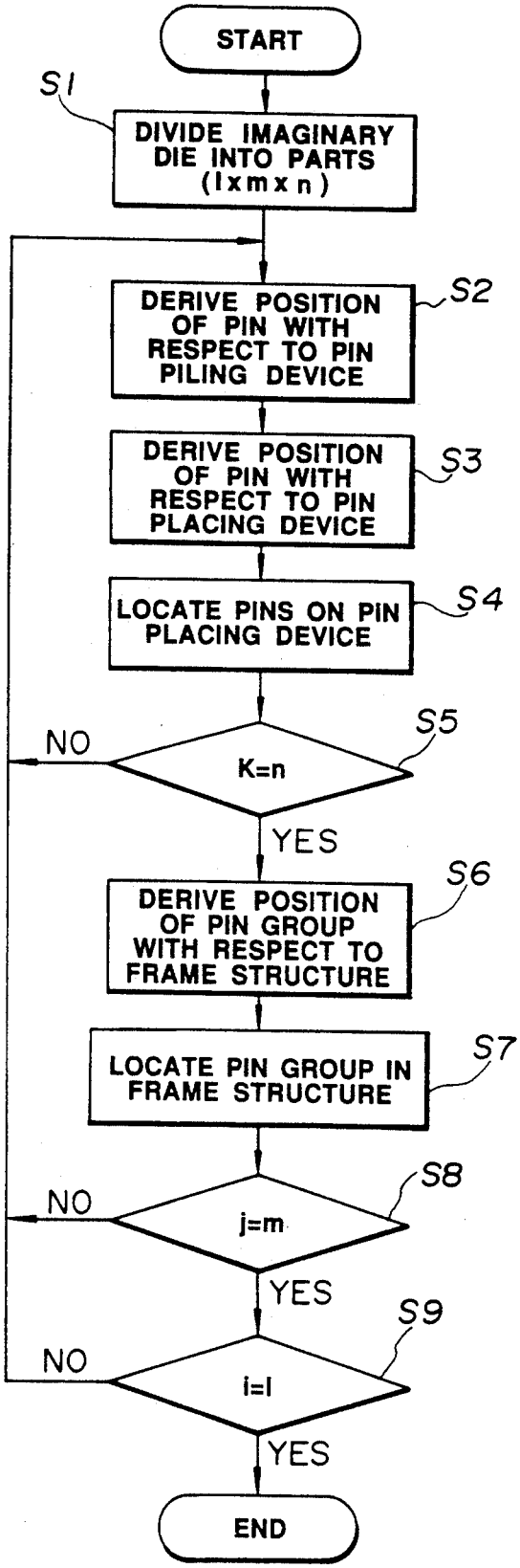
FIG. 7 is a flowchart depicting operation steps programmed in a computer, which are carried out by the apparatus of the first embodiment.
Figure 8:
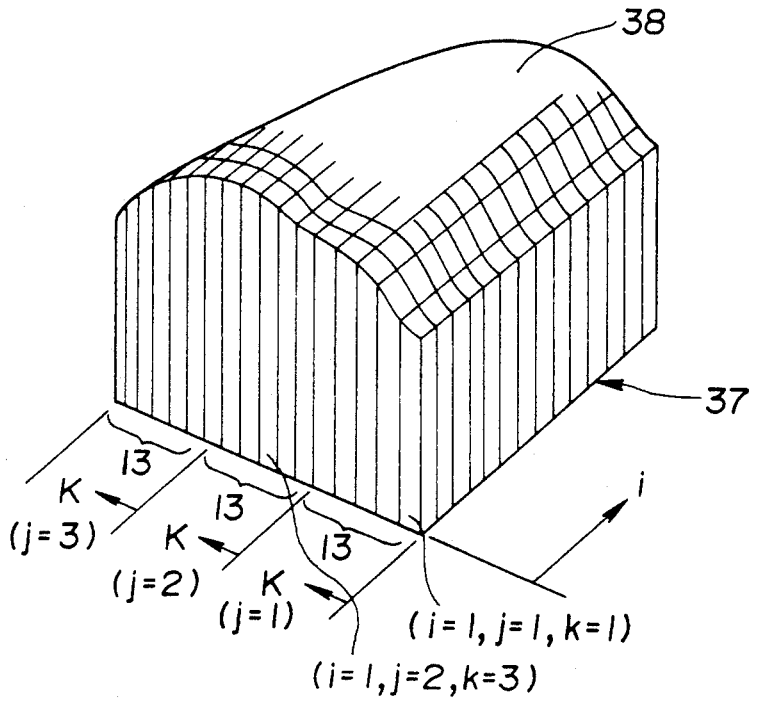
FIG. 8 is a perspective view of a computer-designed imaginary casted metal die which is to be produced through a variable configuration die produced through the apparatus of the first embodiment.
Figure 9:
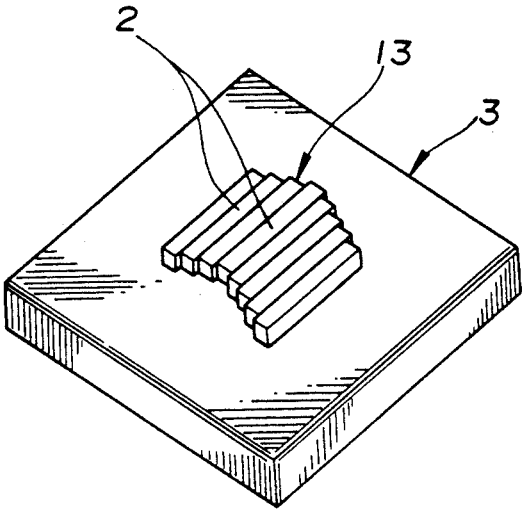
FIG. 9 is a perspective, but partial, view of the pin placing device, with one group of pins placed thereon.

In the following, the method of producing the variable configuration die 31 will be described in detail with reference to FIGS. 7 and 8. FIG. 7 shows a flowchart which depicts the operation steps programmed in the computer of the main controller 9 (see FIG. 1), and FIG. 8 is a computer-designed imaginary casted metal die 37 which is to be produced through the variable configuration die 31. Designated by numeral 38 is a smoothed convex die surface possessed by the imaginary die 37.

At step S1, the imaginary die 37 is divided into a plurality (viz.,"l"×"m"×"n") of small rectangular pin parts of identical cross section by using mutually intersected imaginary cutting planes which are perpendicular to a flat bottom surface of the imaginary die 37, wherein:

"n" : the number of the pins 2 which are carried by the pin handling robot 6 at one carrying action (viz., the number of the pins 2 which constitute one pin group 13), "m" : the number of times for which the pin handling robot 6 repeats the pin group carrying action to constitute one layer of the pins 2 on the pin piling device 4 (viz., the number of the pin groups 13 required for constituting one layer of the pins 2 on the pin piling device 4), and "l" : the number of the layers of the pins 2 required for constituting the entire of the die 31.

At step S2, the three dimensional position (X, Y, Z) of a pin 2 located at "nk" place of a pin group 13 located at "li" and "mi" is calculated, and at step S3, the position of the pin 2 with respect to the flat board member 16 of the pin placing device 3 is calculated.

At step S4, the pin placing robot 5 is controlled to place the pin 2 onto the flat board member 16 at the position which is calculated.

This step is repeated for given times "n". That is, at step S5, a judgement as to whether such step is repeated for given times or not (that is, "k"="n" or not) is carried out. If "Yes", as is seen from FIG. 9, a pin group 13 which is to be positioned at "li" and "mj" is arranged on the flat board member 16 of the pin placing device 3.

At step S6, the position of the pin group 13 with respect to the frame structure 28 of the pin piling device 4 is calculated.

At step S7, the pin handling robot 6 is controlled to transfer the pin group 13 into the frame structure 28 at the position which is calculated.

Figure 10:
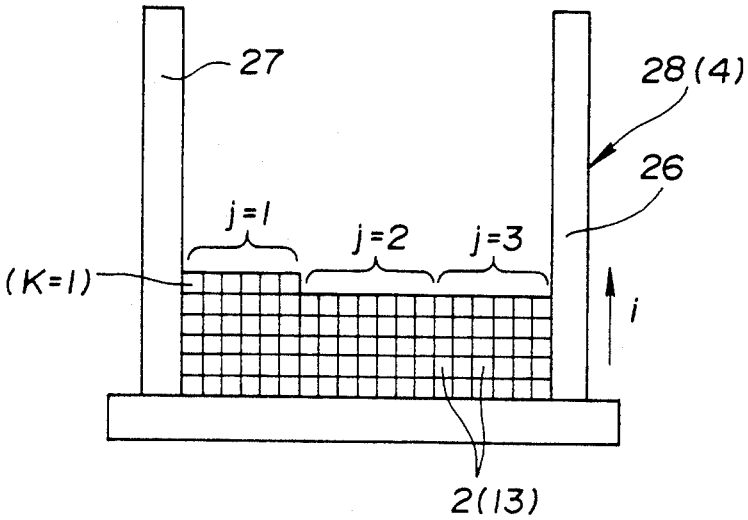
FIG. 10 is a front view of the pin piling device in a condition wherein the grouped pins are being piled.
Figure 11:
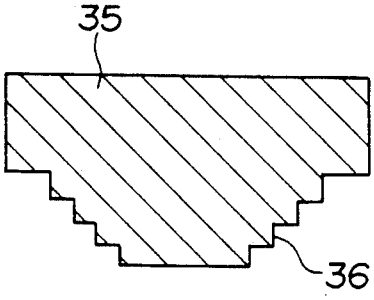
FIG. 11 is a sectional view of a casted metal die which is produced from a variable configuration die which is produced from the apparatus of the first embodiment.

This step is repeated for given times to pile the pin groups 13 in the frame structure 28, as is seen from FIG. 10.

That is, at step S8, a judgement as to whether "j" is "m" or not is carried out. If "Yes", at step S9, a judgement as to whether "i" is "l" or not is carried out. If "Yes", the piling action of the pin handling robot 6 stops.

With these steps, a predetermined number of pins 2 are piled in layers in the frame structure 28 of the pin piling device 4.

Then, as is seen from FIG. 1, the upper wall member 25 is bolted to the vertical base board 23 and the bolts 33 of the wall members 25 and 26 are manipulated. With these steps, the variable configuration die 31 as shown in FIG. 5 is fixed in the pin piling device 4.

As is seen from FIG. 6, the pin piling device 4 is then raised up together with the fixed die 31 so that the recessed die surface 32 of the die 31 faces upward, and melted metal 34 is casted into the recess of the die 31.

After being cooled, the casted metal block 35 (see FIG. 11) is removed from the die 31. Due to unevenness of the recessed die surface 32 of the die 31, the produced metal block 35 has an uneven convex die surface 36. Thus, the block 35 is machined to smooth the die surface 36. With this, the block 35 has a smoothed convex die surface which is identical to the die surface 38 of the imaginary die 37 of FIG. 8.

Although the above description is directed to an example for producing a casted metal die 35, a dissipation model for casted metal dies can be produced by taking substantially the same steps. That is, styrene resin beads are poured into the recess 32 of the die 31 and then suitable heat and pressure are applied to them to form a foamed dissipation model.

Figure 12:
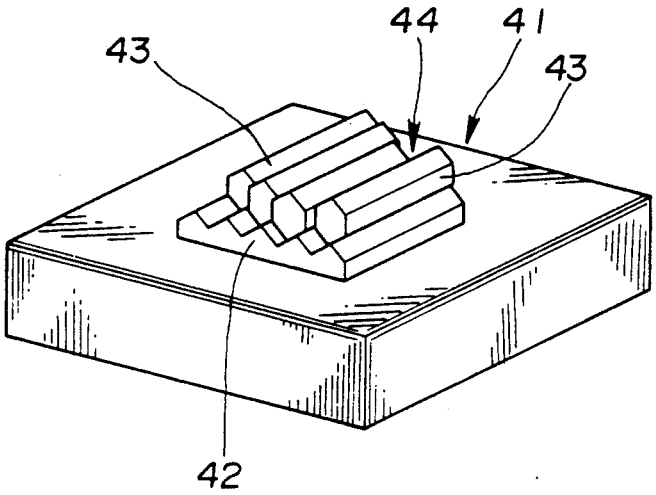
FIG. 12 is a perspective, but partial, view of a pin placing device employed in an apparatus of a second embodiment of the present invention.
Figure 13:
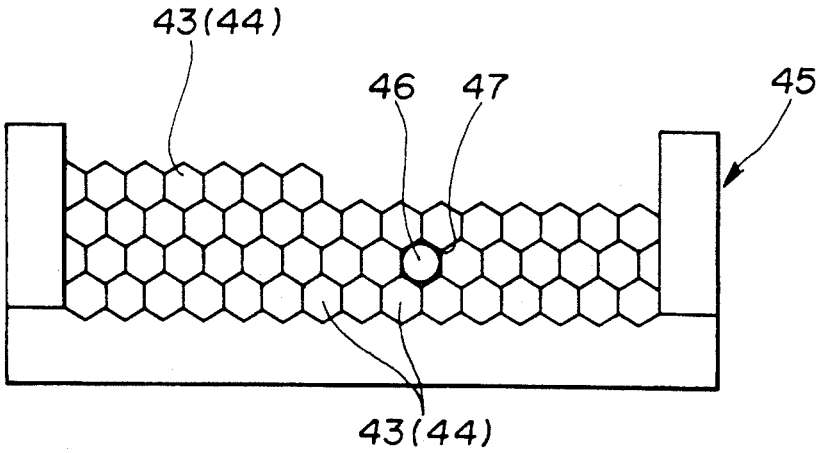
FIG. 13 is a front, but partial, view of a pin piling device employed in the second embodiment.

Referring to FIGS. 12 and 13, there are respectively shown a pin placing device 41 and a pin piling device 45 which are employed in a second embodiment of the present invention.

As is seen from FIG. 12, the pin placing device 41 of this second embodiment has a board member 42 formed with parallel grooves of sawteeth cross section. A predetermined number of hexagon metal pins 43 are used in place of the rectangular pins 2, which are placed in the grooves to constitute the pin group 44. The pin groups 44 provided by the pin placing device 41 are transferred to the pin piling device 45 (see FIG. 13) one after another in such a manner as has been described in the first embodiment.

As is seen from FIG. 13, one of the pins 43 is a cylindrical pin 46. In this case, a suitable clearance 47 is provided around the pin 46, which can serve as a gas discharging passage during the melted metal casting.

Figure 14:
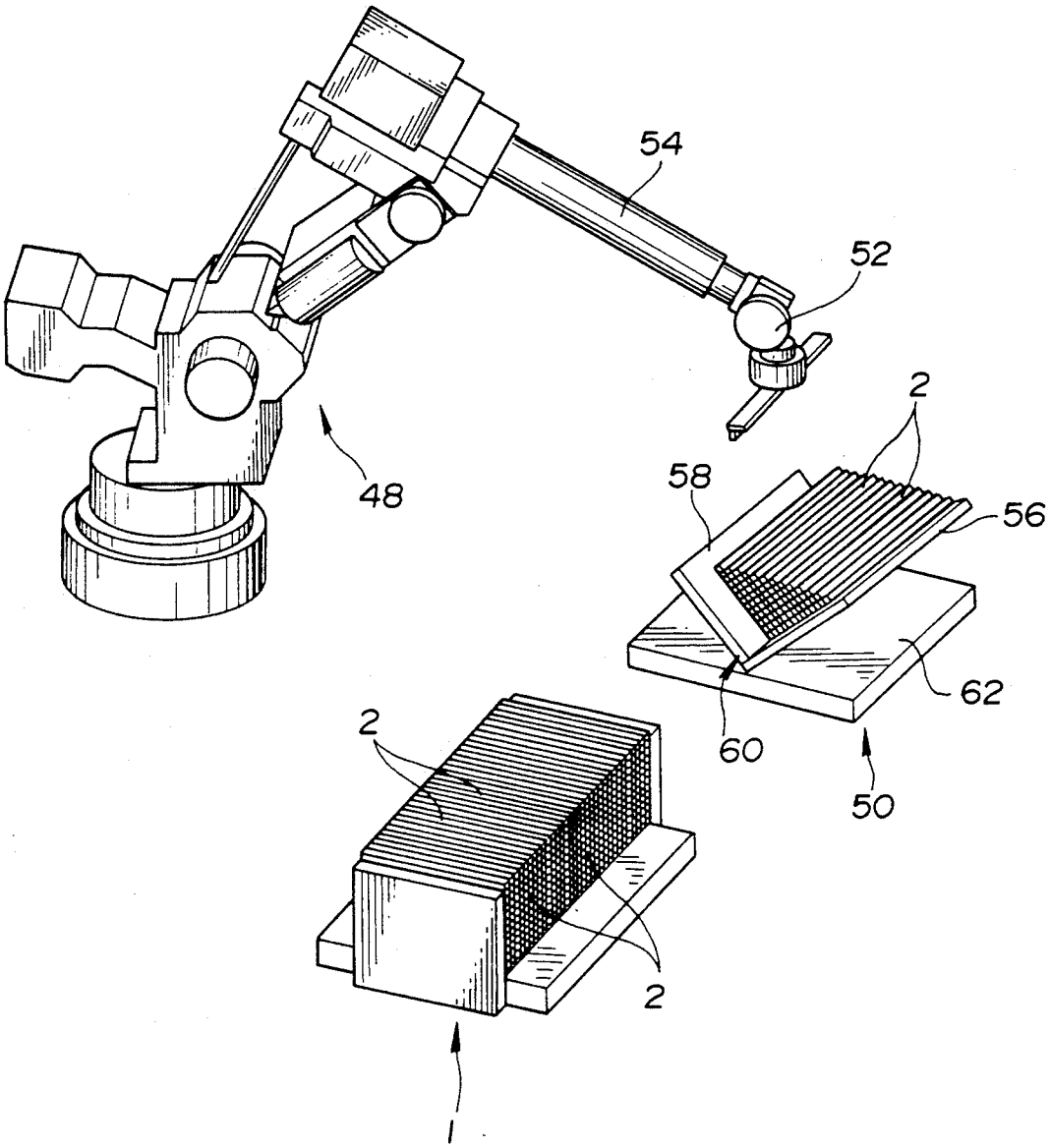
FIG. 14 is a perspective view of an apparatus of a third embodiment of the present invention.

Referring to FIGS. 14 to 21, particularly FIG. 14, there is shown an apparatus of a third embodiment of the present invention.

In FIG. 14, denoted by numeral 1 is a magazine in which a plurality of rectangular metal pins 2 are received. Denoted by numeral 48 is a pin handling robot and 50 is a pin piling device.

The pin handling robot 48 has a manipulator hand 52 at a leading end of an arm 54. Receiving instruction signals from a computerized robot controller (not shown), the pin handling robot 48 picks up one of the pins 2 from the magazine 1 and locates the same onto a predetermined position in the pin piling device 50. This operation is repeated by predetermined times for producing a recessed block 19 of piled pins 2 on the pin piling device 50.

Figure 15:
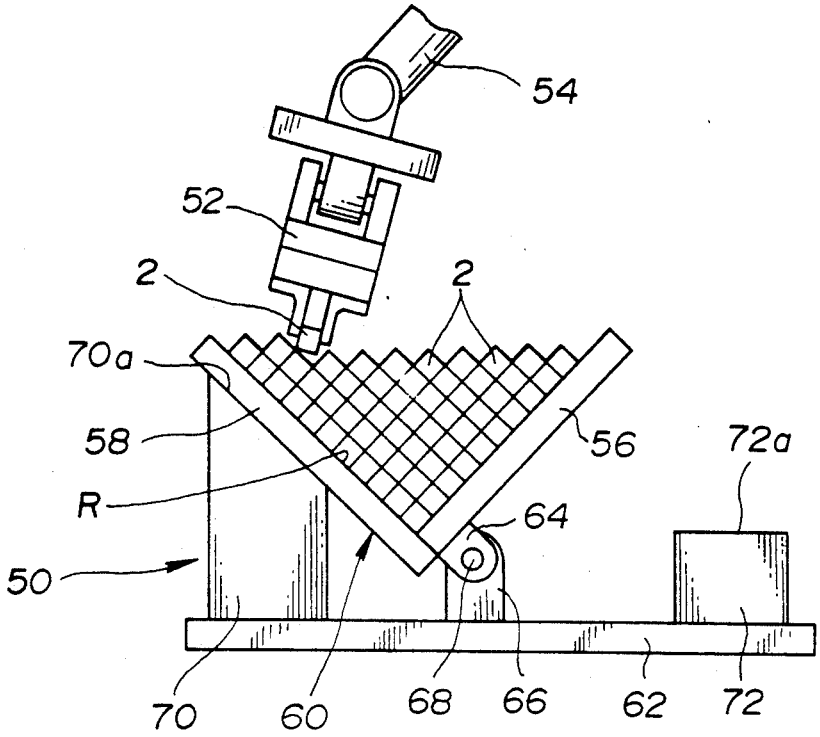
FIG. 15 is a front view of a pin piling device employed in the third embodiment.
Figure 16:
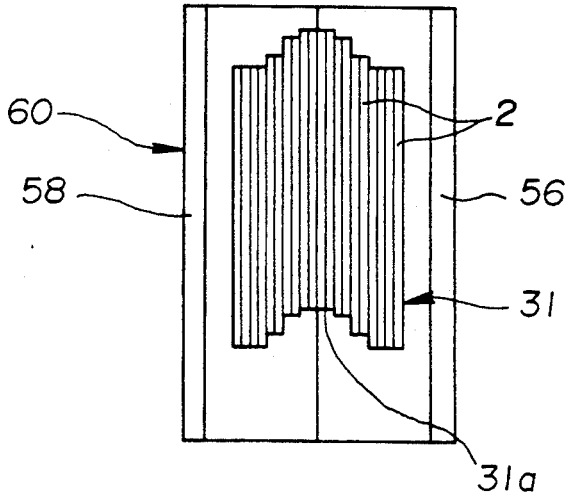
FIG. 16 is a plan view of the pin piling device of FIG. 15.

As is shown in FIGS. 14, 15 and 16, the pin piling device 50 comprises a channel structure 60 including intersected side walls 56 and 58. The channel structure 60 is pivotally mounted on a base plate 62 through a hinge mechanism which comprises a first bracket 64 secured to the channel structure 60, a second bracket 66 secured to the base plate 62 and a pivot pin 68 pivotally connecting the first and second brackets 64 and 66.

Figure 19:
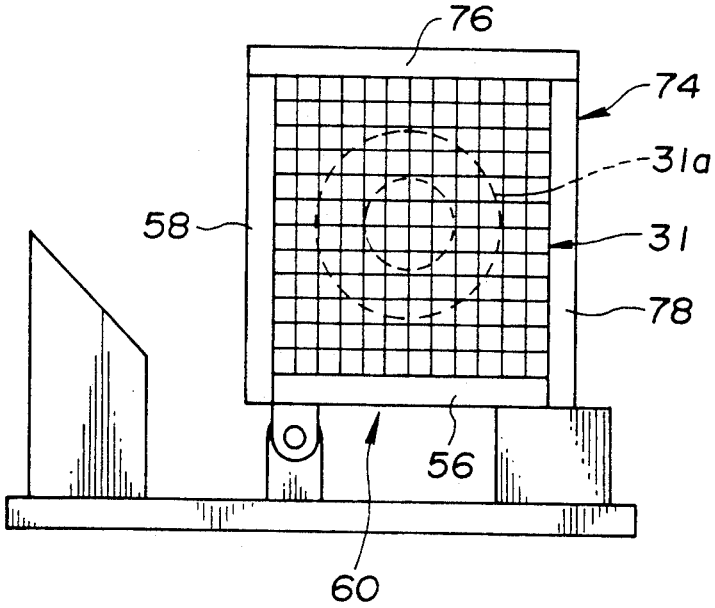

As is shown in FIG. 15, first and second stopper members 70 and 72 are mounted on the base plate 62 at different positions in order to selectively hold the channel structure 60 at an inclined position "P1" and a raised position "P2" (see FIG. 19). For this, the first stopper member 70 has an inclined stopper surface 70*a* against which the side wall 58 abuts when the channel structure 60 assumes the inclined position "P1". While, the second stopper member 72 has a horizontal stopper surface 72*a* against which the other side wall 56 abuts when the channel structure 60 assumes the raised position "P2". Preferably, the inclined stopper surface 70*a* inclines about 45 degrees with respect to the upper flat surface of the base plate 62.

Although not shown in the drawings, the pivotal movement of the channel structure 60 between the inclined position "P1" and the raised position "P2" is effected by a hydraulic power system.

Figure 18:
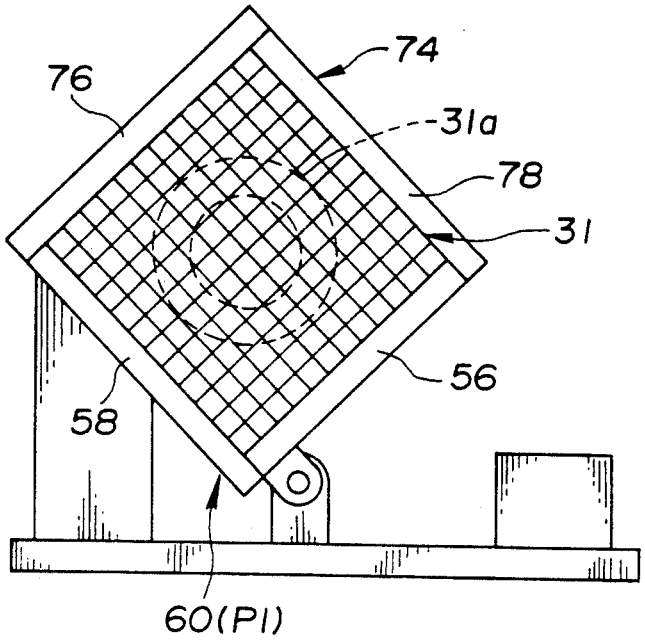

As is shown in FIG. 18, the pin piling device 50 further comprises a detachable auxiliary channel structure 74 which has substantially the same construction as the above-mentioned channel structure 60. The auxiliary channel structure 74 includes mutually intersected side walls 76 and 78. As is shown, when the auxiliary channel structure 74 is properly mounted on the base channel structure 60, the side wall 76 faces the side wall 56, and the side wall 78 faces the side wall 58. Although not shown in the drawing, a suitable fastener is employed for combining these two channel structures 74 and 60.

It is however to be noted that during the pin piling process, the auxiliary channel structure 74 is kept away from the pin piling device 50, as is seen from FIG. 14.

In the following, the method of producing a casted metal die 35 (see FIG. 21) will be described with reference to the drawings particularly FIG. 14.

First, a variable configuration die 31 for producing the die 35 is produced.

Prior to effecting the pin piling action by the pin handling robot 54, the channel structure 60 of the pin piling device 50 is forced to assume the inclined position "P1".

Figure 17:
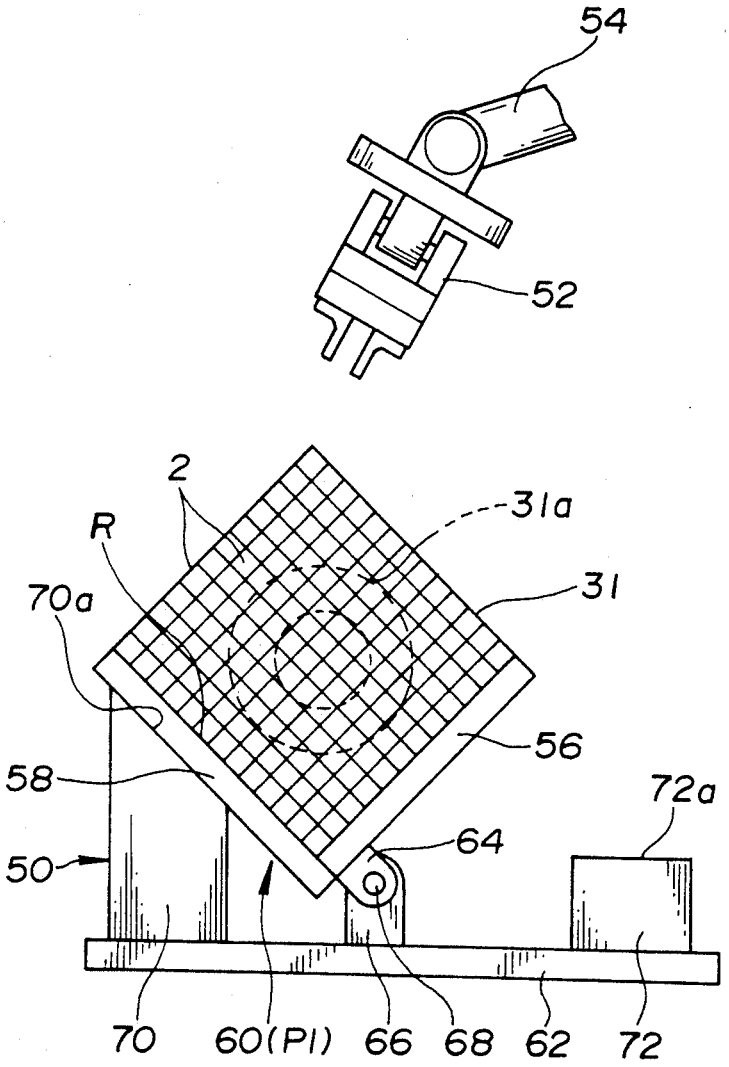
FIGS. 17, 18 and 19 are front views of the pin piling device of FIG. 15, showing various conditions of the same.

By using a computer, the die 35 (see FIG. 21) which is to be produced is analyzed to prepare data representative of the three-dimensional form of the die 35. In accordance with the data, the pin handling robot 54 is operated to transfer the pins 2 from the magazine 1 to given positions in the channel structure 60 one after another. That is, as is seen from FIG. 15, a first pin 2 is placed in the lowermost part of the V-shaped recess "R" of the channel structure 60, and then second and third pins are placed on given positions of the first pin to produce a second layer of piled pins, and then, third, fourth and fifth pins are placed on the second and third pins to produce a third layer of piled pins. Like this, the pin piling action is continued until the pins 2 constitute a generally rectangular block 31 of piled pins 2, as is shown in FIG. 17.

As is understood from FIG. 16, the block 31 has a recessed die surface 31*a* defined by one ends of the piled pins 2.

Then, as is seen from FIG. 18, the auxiliary channel structure 74 is fixed to the base channel structure 60. With this, the block 31 becomes fixed to complete the pin-made die 31, that is, the variable configuration die 31.

Then, as is seen from FIG. 19, the unit of the channel structures 60 and 74 is pivoted to assume the raised position "P2".

Figure 20:
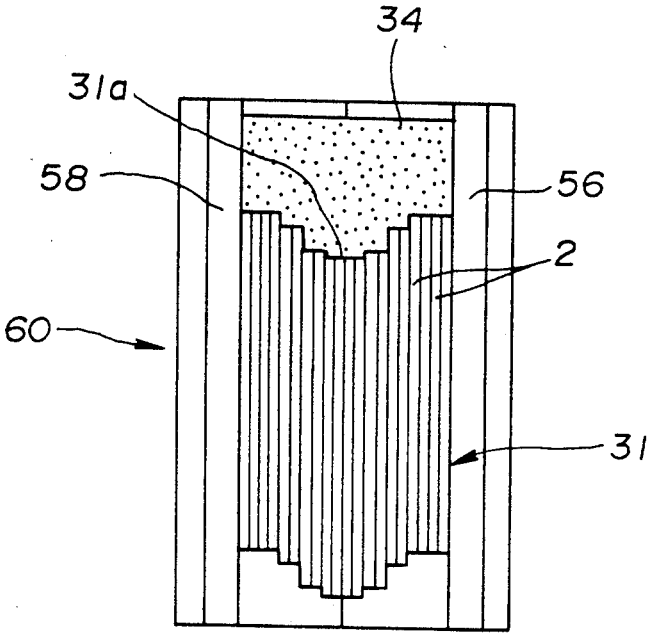
FIG. 20 is a view similar to FIG. 16, but showing a condition wherein melted metal is casted into a cavity defined by one ends of the piled pins.
Figure 21:
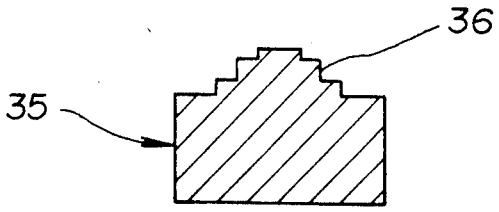
FIG. 21 is a sectional view of a casted metal die which is removed from the cavity of the piled pins of FIG. 20.

Then, as is seen from FIG. 20, the entire construction of the pin piling device 50 is raised so that the recessed die surface 31*a* of the die 31 faces upward, and then melted metal 34 is casted into the recess 31*a* of the die 31.

After being cooled, the casted metal block 35 (that is, the die 35) is removed from the pin-made die 31. The uneven convex surface 36 of the block 35 is smoothed to complete the die 35 .

Figure 22:
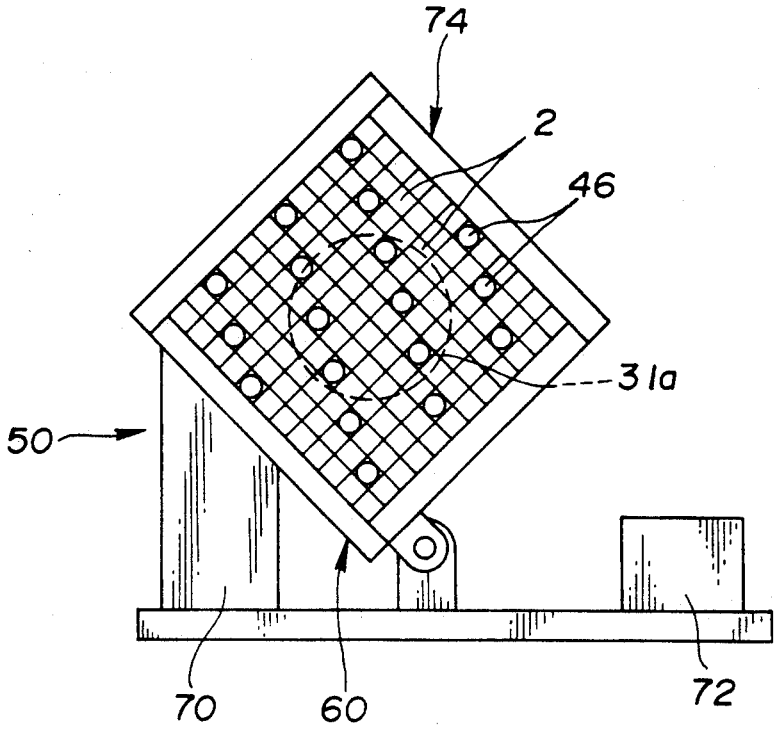
FIG. 22 is a view similar to FIG. 18, but showing a pin piling device employed in an apparatus of a fourth embodiment of the present invention.
Figure 23:
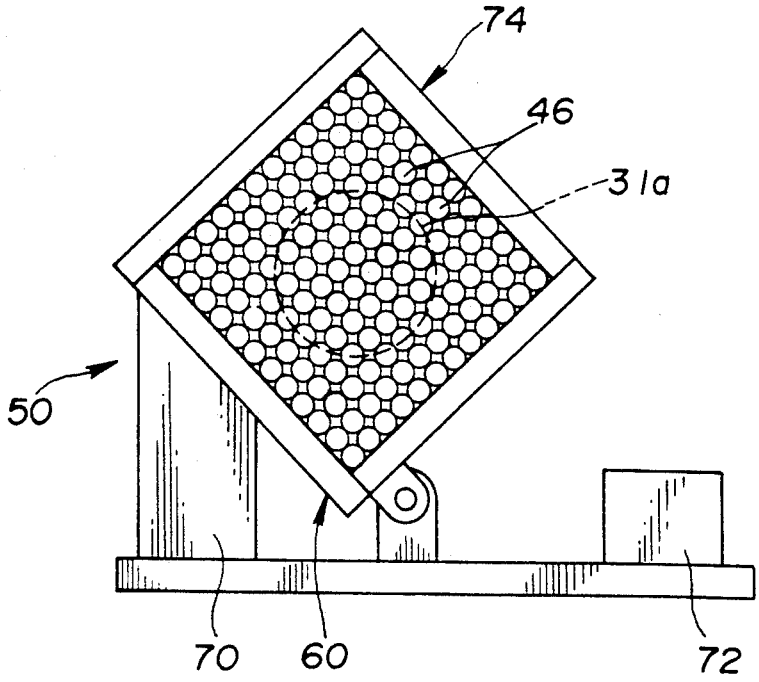
FIG. 23 is a view also similar to FIG. 18, but showing a pin piling device employed in an apparatus of a fifth embodiment of the present invention.

Referring to FIGS. 22 and 23, there are shown pin piling devices 50 depicting fourth and fifth embodiments of the present invention.

In the fourth embodiment of FIG. 22, a suitable number of cylindrical pins 46 are employed in the piled rectangular pins 2. In this case, a plurality of clearances "G" are provided around the cylindrical pins 46, which serve as the gas discharging passages during the metal casting.

In the fifth embodiment of FIG. 23, the pins used are all cylindrical. In this case, many gas discharging passages are provided.

Figure 24:
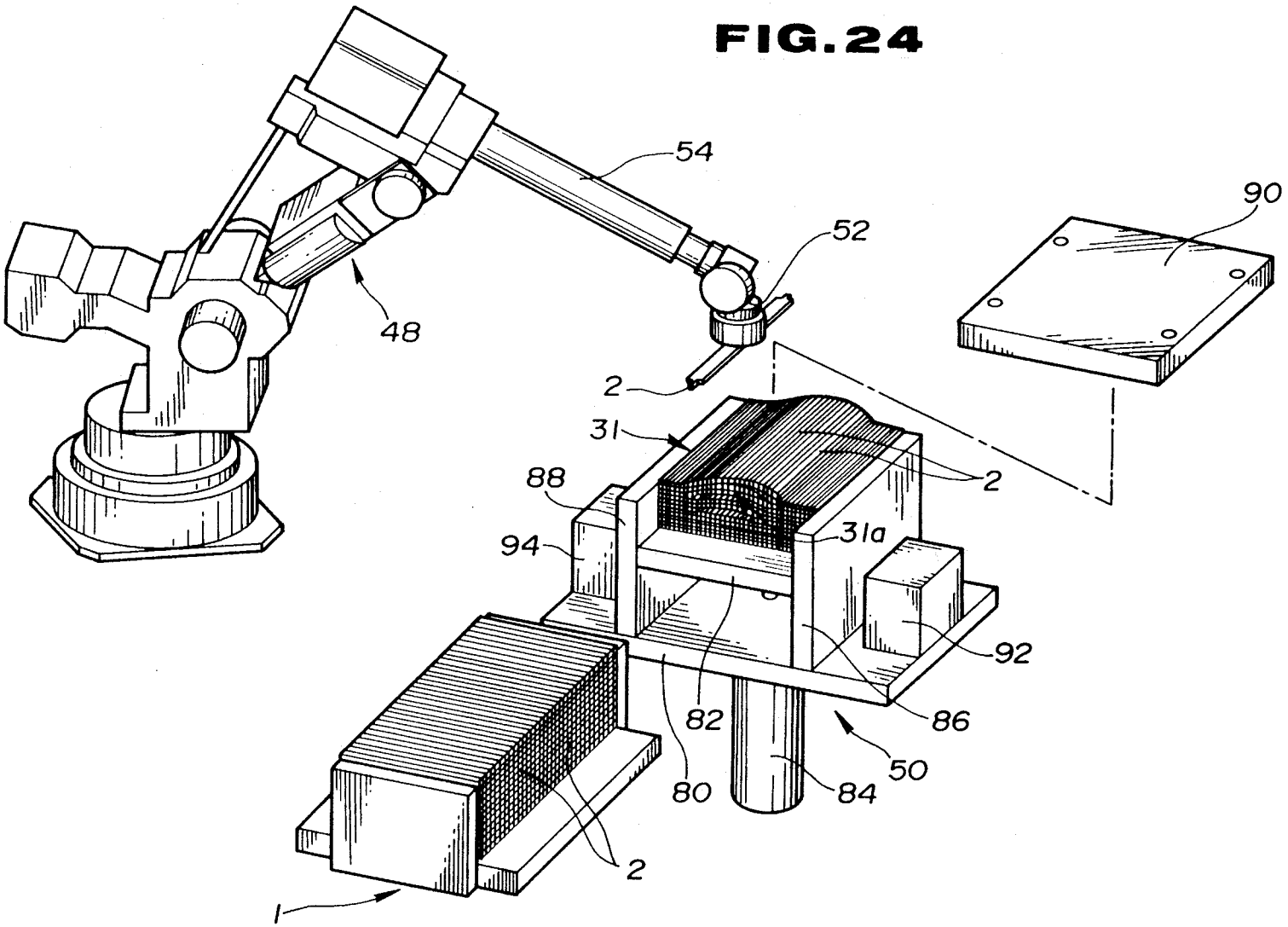
FIG. 24 is a perspective view of an apparatus of a sixth embodiment of the present invention.

Referring to FIGS. 24 to 32, particularly FIG. 24, there is shown an apparatus of a sixth embodiment of the present invention.

In FIG. 24, denoted by numeral 1 is a magazine in which a plurality of rectangular identical metal pins 2 are neatly received. Denoted by numeral 48 is a pin handling robot and 50 is a pin piling device.

The pin handling robot 48 has a manipulator hand 52 at a leading end of an arm 54. Receiving instruction signals from a computerized robot controller (not shown), the pin handling robot 48 picks up one of the pins 2 in the magazine 1 and locates the same onto a predetermined position in the pin piling device 50. This operation is repeated by predetermined times for producing a recessed block 31 of piled pins 2 on the pin piling device 50.

Figure 25:
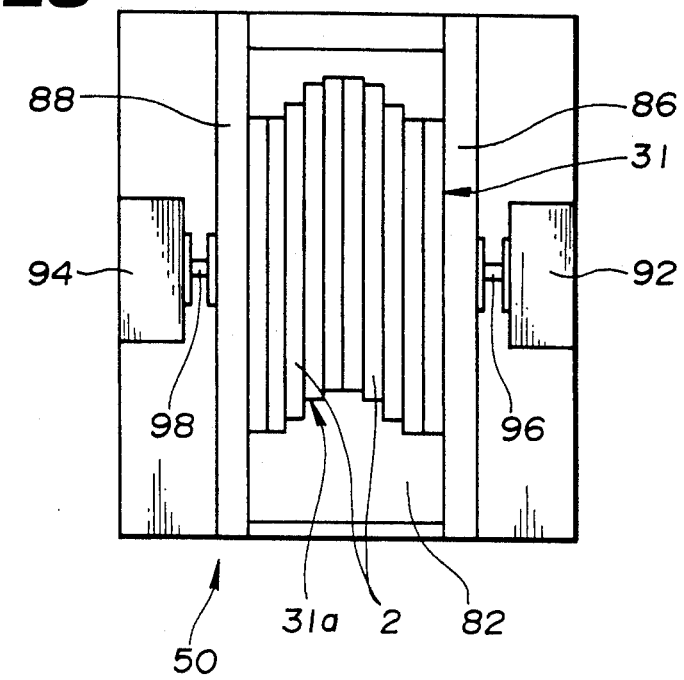
FIG. 25 is a plan view of a pin piling device employed in the sixth embodiment.
Figure 26:
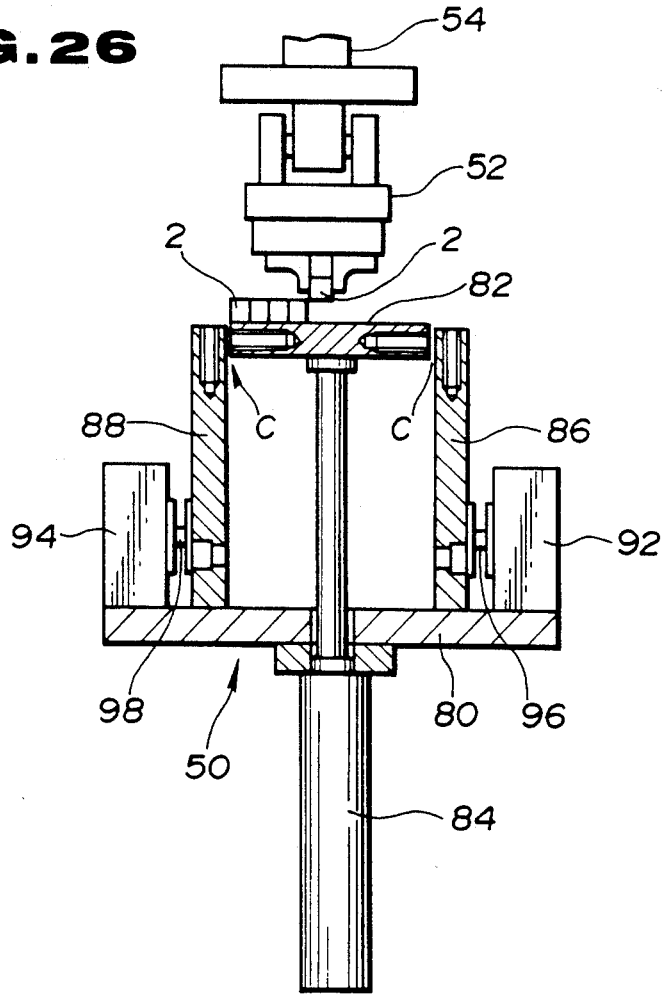
FIG. 26 is a front view of the pin piling device of FIG. 25.
Figure 27:
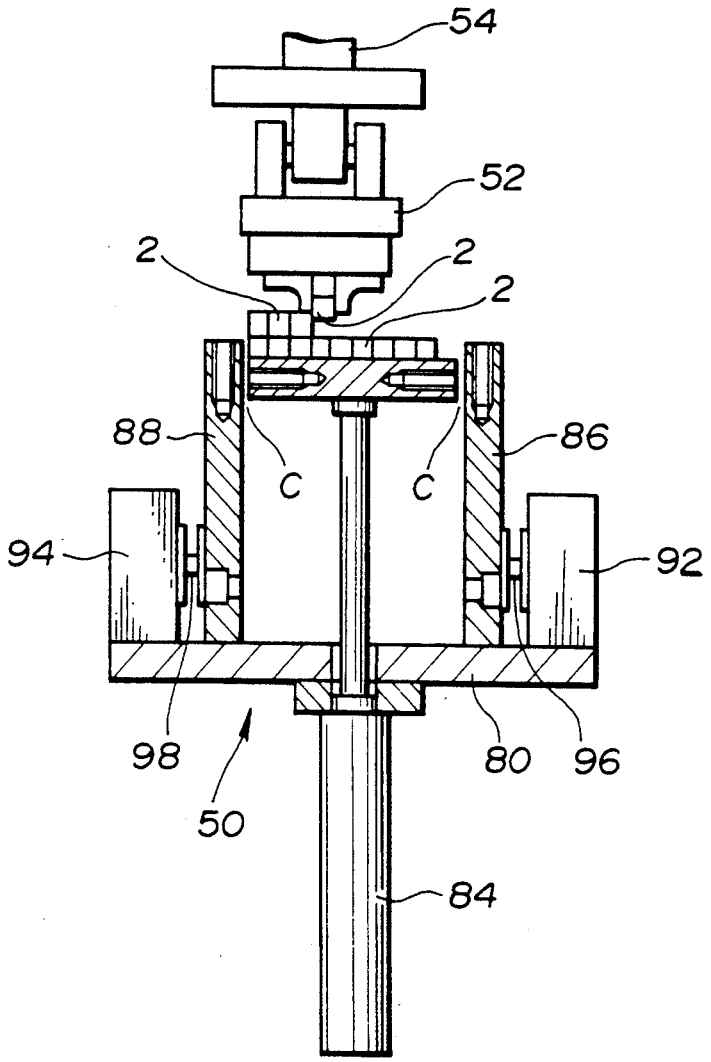
FIGS. 27, 28 and 29 are front view of the pin piling device of FIG. 25, showing various conditions of the same.

As is shown in FIGS. 24, 25 and 26, the pin piling device 50 comprises a horizontal base plate 80, a lifter table 82 vertically movably arranged on the base plate 80, a hydraulic power system 84 for carrying out the vertical movement of the lifter table 82, a pair of side walls 86 and 88 laterally slidably mounted on the base plate 80 having the lifter table 82 put therebetween and a detachable upper wall 90.

As is understood from FIGS. 25 and 26, the lateral movement of each side wall 86 or 88 is carried out by a hydraulic power system which includes a hydraulic cylinder 92 or 94 and a piston rod 96 or 98.

Although not shown in the drawings, a suitable fastener means, such as, bolts and nuts, is employed for fixing the detachable upper wall 90 to the side walls 86 and 88. However, during the pin piling process, the upper wall 90 is kept away from the pin piling device 50, as is seen from FIG. 24.

In the following, the method of producing a casted metal die 35 (see FIG. 32) will be described with reference to the drawings, particularly FIG. 24.

First, a variable configuration die 31 for producing the die 35 is produced.

That is, prior to effecting the pin piling action by the pin handling robot 54, the lifter table 82 of the pin piling device 50 is moved up to the uppermost position and the side walls 86 and 88 are somewhat separated from the side edges of the lifter table 82 to allow the vertical movement of the lifter table 82. The reference "C" of FIG. 26 shows the small clearance defined between the lifter table 82 and each side wall 86 or 88.

By using a computer, the final product, that is, the casted metal die 35 (see FIG. 32) is analyzed to prepare various data representative of the shape of the die 35. In accordance with this data, the pin handling robot 54 is operated to transfer the pins 2 from the magazine 1 to given positions in the pin piling device 50 one after another.

Figure 30:
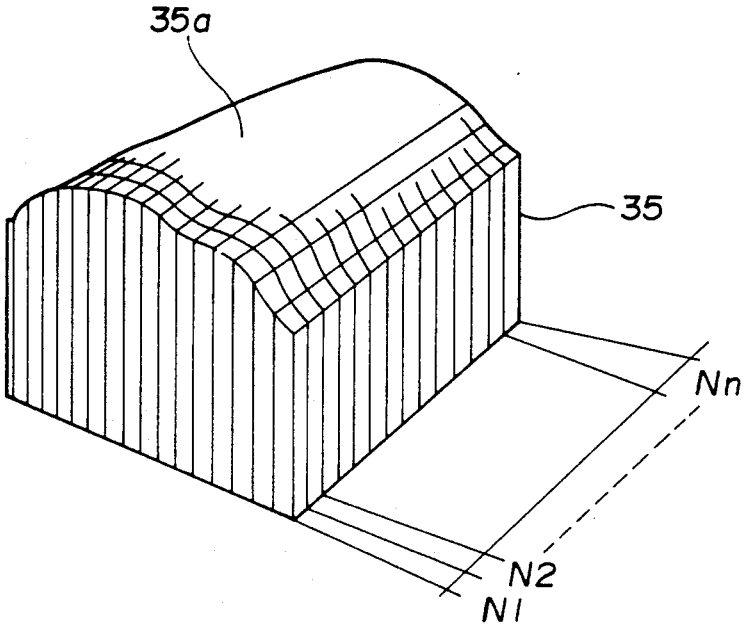
FIG. 30 is a perspective view of a computer-designed imaginary die which is to be produced through a variable configuration die produced via the apparatus of the sixth embodiment.

That is, as is shown in FIG. 30, a computer-aided image for the die 35 is divided into a plurality of small rectangular pin parts of identical cross section by using mutually intersected imaginary cutting planes which are perpendicular to a flat bottom surface of the imaginary die 35.

It is to be noted that the rectangular pin parts denoted by N1, N2, . . . Nn are those which constitute a first layer of the pin-made die 31 which is to be provided by the pin piling device 50.

As is understood from FIG. 26, a first pin 2 is placed on a first given position of the lifter table 82 and then a second pin 2 is placed on a second given position beside the first given position and like this, third, fourth, fifth and given numbered pins 2 are placed on their given positions until they constitute the first layer of the pin-made die 31, which correspond to the pin parts N1, N2, . . . Nn.

When the pins 2 constitute the first layer, the lifter table 82 is moved down by a distance which corresponds to the thickness of the pin 2. Then, similar pin piling action is carried out by the pin handling robot 48 until a second layer for the pin-made die 31 is produced, as will be seen from FIG. 27.

Figure 28:
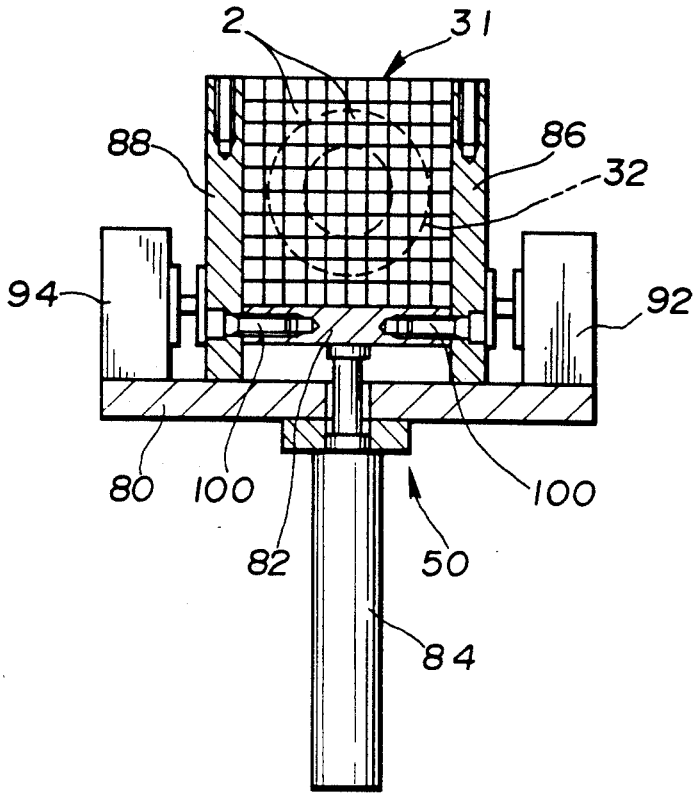

This pin piling action is repeated until the pins 2 complete the pin-made die 31, as is understood from FIG. 28. The pin-made die 31 has a recessed die surface 31*a* which is defined by one ends of the piled pins 2.

Then, the side walls 86 and 88 are advanced by the hydraulic power system to tightly sandwich the pin-made die 31 therebetween. Then, by using bolts 100, the side walls 86 and 88 are fixed to the lifter table 82.

Figure 29:
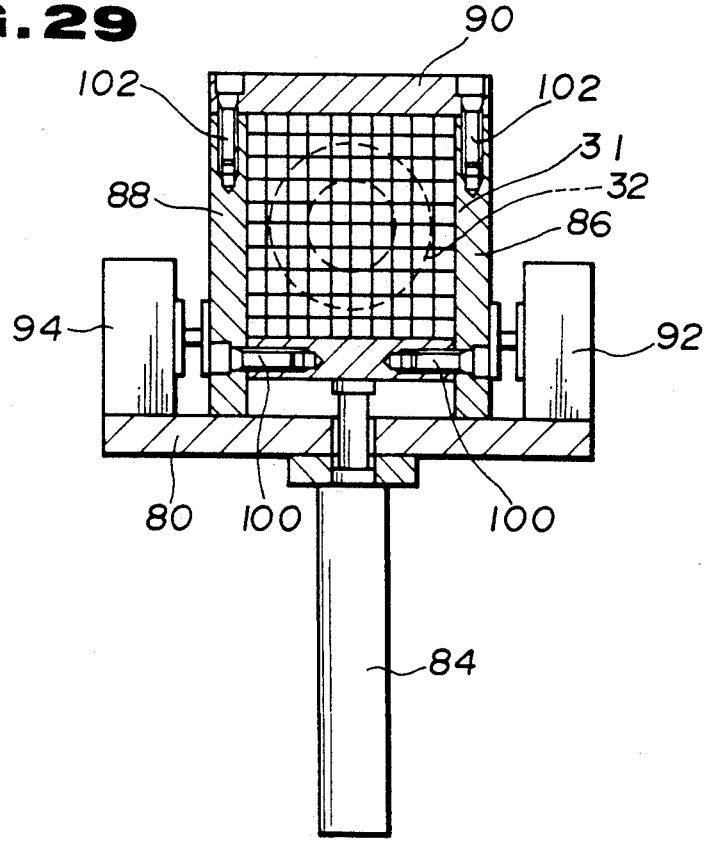

Then, as is seen from FIG. 29, the upper wall 90 is fixed to the side walls 86 and 88 by using bolts 102. With this, the pin-made die 31 becomes fixed in the pin piling device 50.

Figure 31:
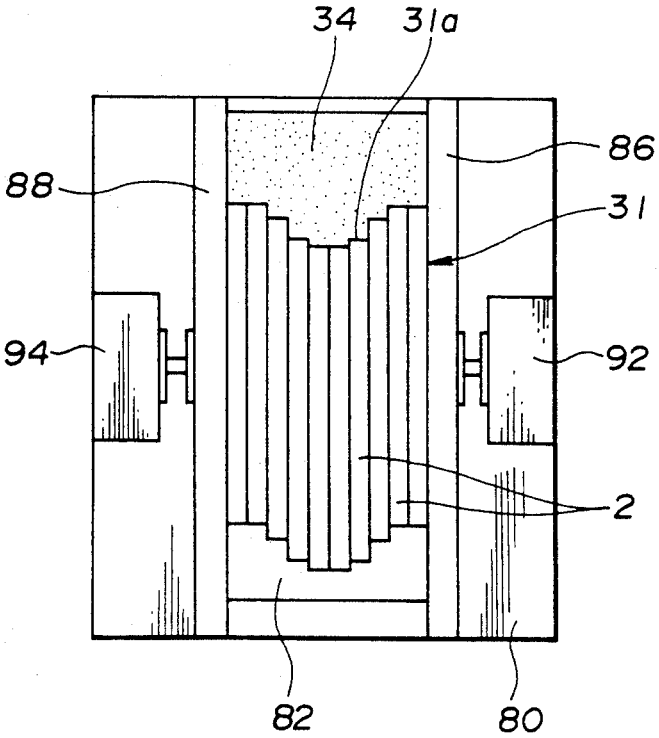
FIG. 31 is a plan view of the pin piling device in a condition wherein melted metal is being casted into a cavity defined by the piled pins.
Figure 32:
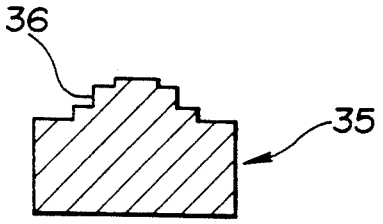
FIG. 32 is a sectional view of a casted metal die which is removed from the cavity of the piled pins of FIG. 31.

Then, as is seen from FIG. 31, the entire construction of the pin piling device 50 is pivoted so that the recessed die surface 31*a* of the die 31 faces upward, and then melted metal 34 is casted into the recess 31*a* of the die 31.

After being cooled, the casted metal block (that is, the casted metal die 35) is removed from the pin-made die 31. The uneven convex surface 36 (see FIG. 32) of the block is smoothed to complete the die 35.

Figure 33:
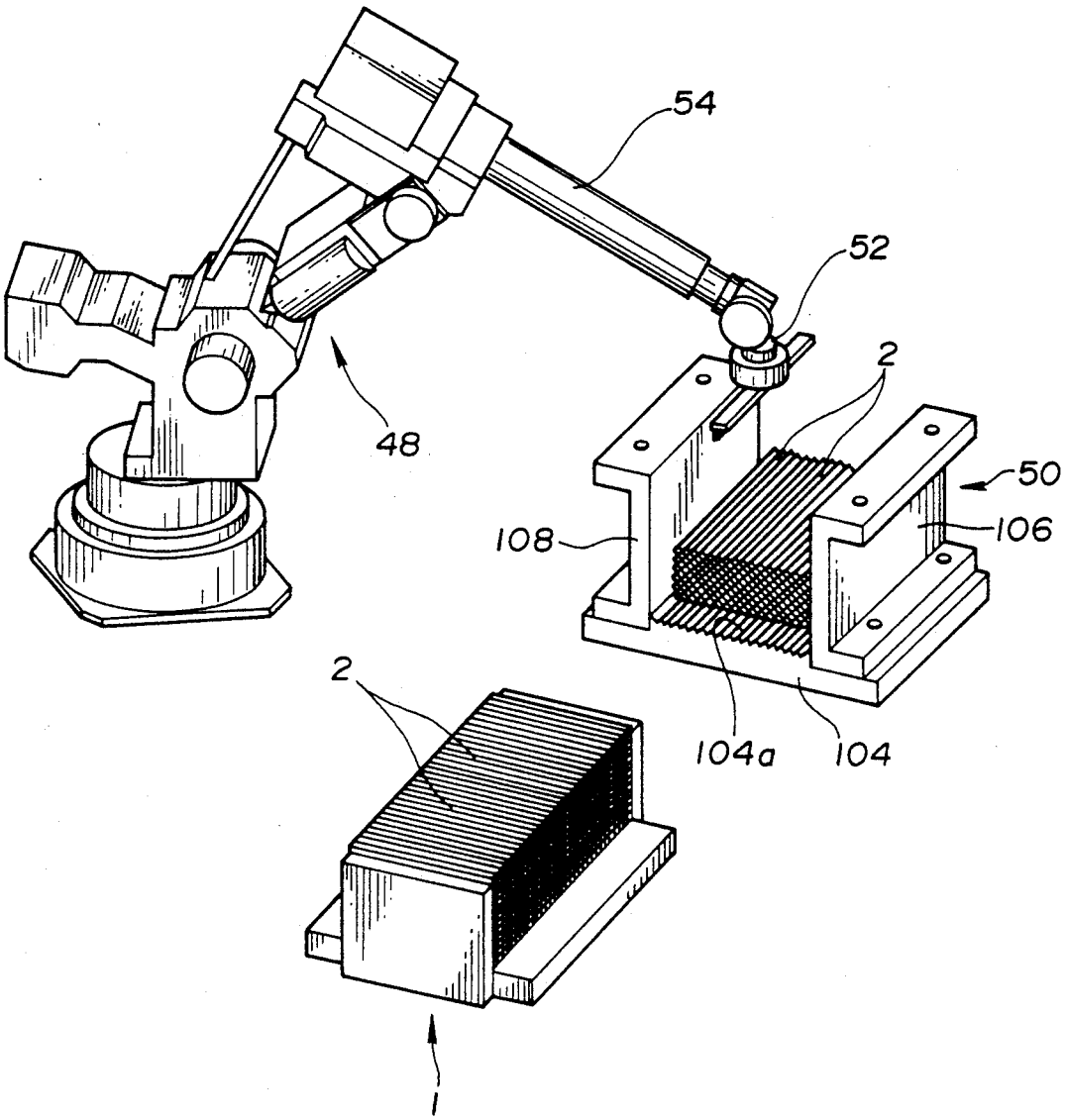
FIG. 33 is a perspective view of an apparatus of a seventh embodiment of the present invention.

Referring to FIGS. 33 to 40, particularly FIG. 33, there is shown an apparatus of a seventh embodiment of the present invention.

In FIG. 33, denoted by numeral 1 is a magazine in which a plurality of rectangular identical metal pins 2 are neatly received. Denoted by numeral 48 is a pin handling robot and 50 is a pin piling device.

The pin handling robot 48 has a manipulator hand 52 at a leading end of an arm 54. Receiving instruction signals from a computerized robot controller (not shown), the pin handling robot 48 picks up one of the pins 2 in the magazine 1 and-locates the same onto a predetermined position in the pin piling device 50. This operation is repeated by predetermined times for producing a recessed block 31 of piled pins 2 in the pin piling device 50.

Figure 34:
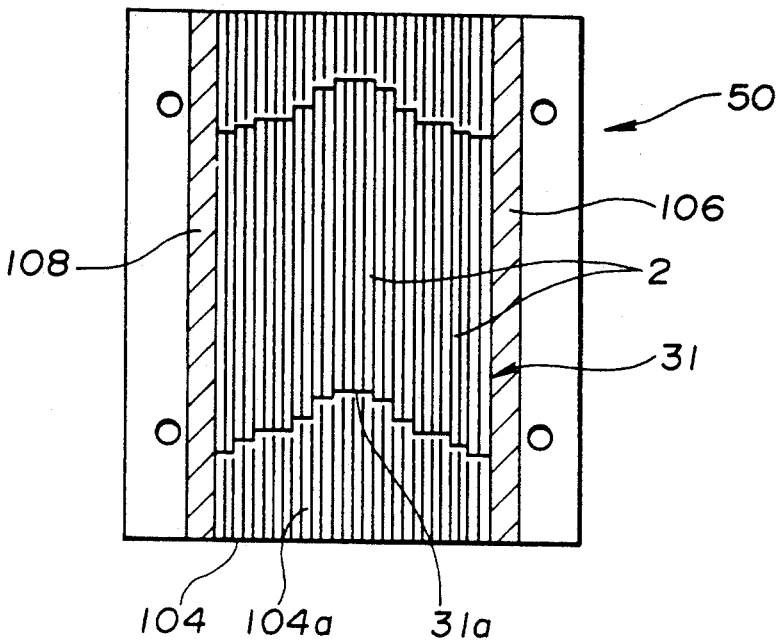
FIG. 34 is a plan view of a pin piling device employed in the seventh embodiment.
Figure 35:
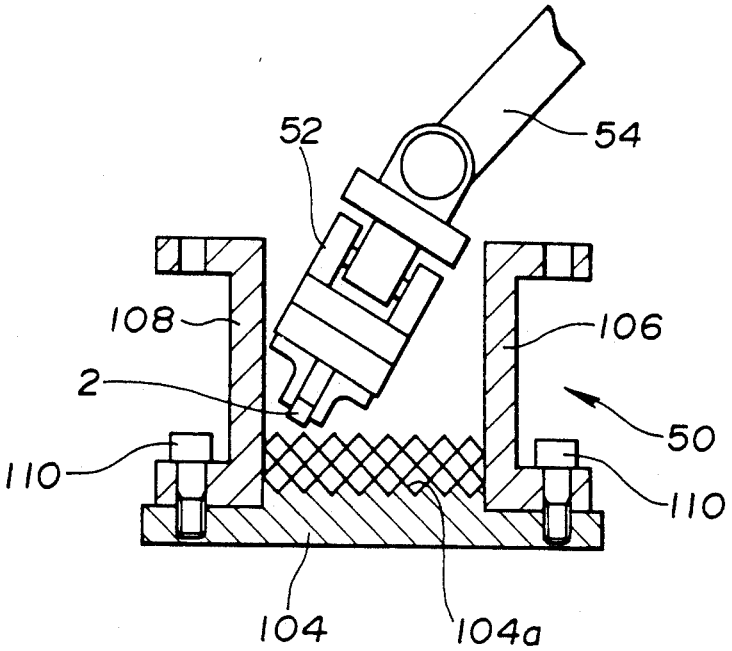
FIGS. 35 and 36 are sectional views of the pin piling device of FIG. 34, showing two conditions of the same.
Figure 36:
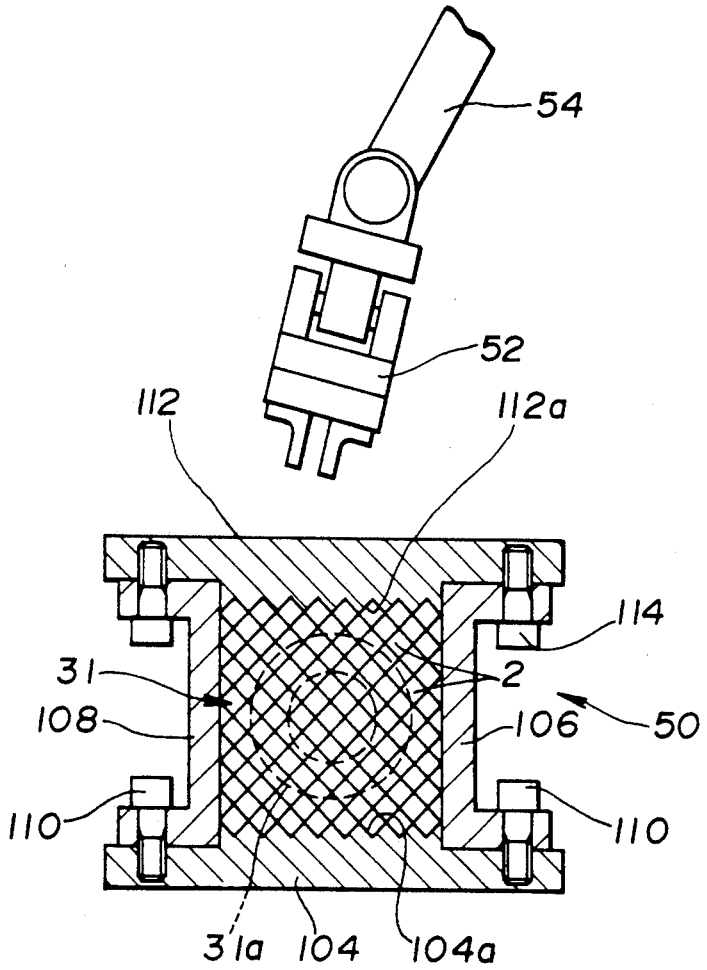

As is shown in FIGS. 33, 34 and 35, the pin piling device 50 comprises a horizontal base plate 104 having parallel grooves 104*a* of saw-teeth cross section formed thereon, a pair of opposed side walls 106 and 108 secured through bolts 110 to the base plate 104, and a detachable upper wall 112 (see FIG. 36). The detachable upper wall 112 has parallel grooves of saw-teeth cross section at its lower surface.

In the following, the method of producing a casted metal die 35 (see FIG. 40) will be described with reference to the drawings, particularly FIG. 33.

First, a variable configuration die 31 (see FIG. 36) for producing the die 35 is produced.

Prior to starting the pin piling action by the pin handling robot 54, the upper wall 112 is kept away from the pin piling device 50, as is seen from FIG. 33.

By using a computer, the die 35 which is to be produced is analyzed to prepare various data which represent the shape of the die 35. In accordance with this data, the pin handling robot 54 is operated to transfer the pins 2 from the magazine 1 to given positions in the pin piling device 50 one after another. That is, as is seen from FIG. 35, a first pin 2 is placed in the leftmost groove 104*a* of the grooved base plate 104, and then a second pin 2 is placed in the neighboring groove 104*a*, and third, fourth and given numbered pins are placed in the given grooves 104*a* in order until they constitute a first layer of the piled pins 2.

When the pin handling robot 48 constitutes the first layer of pins 2, the same starts operation to constitute a second layer of pins 2 on the first layer, by taking similar pin carrying steps.

This pin piling action is repeated until the pins 2 complete the pin-made die 31, as is understood from FIG. 36. The pin-made die 31 has a recessed die surface 31*a* defined by one ends of the piled pins 2.

Figure 37:
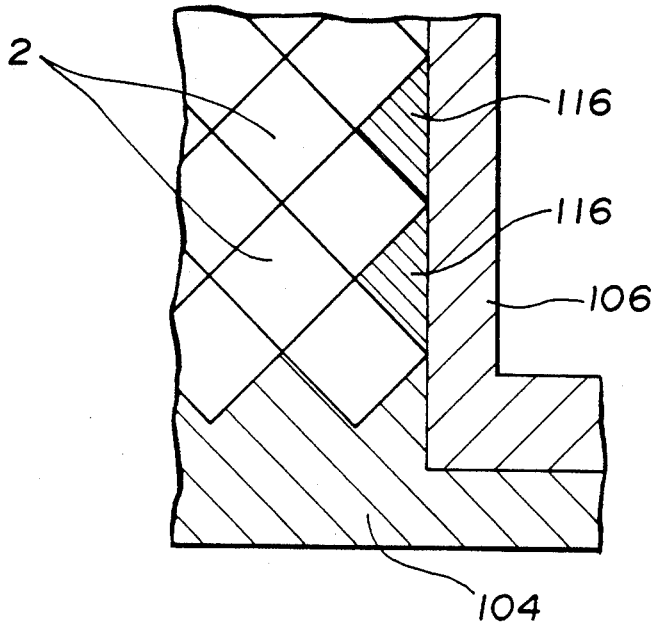
FIGS. 37 and 38 are enlarged views of essential portions of FIG. 36.
Figure 38:
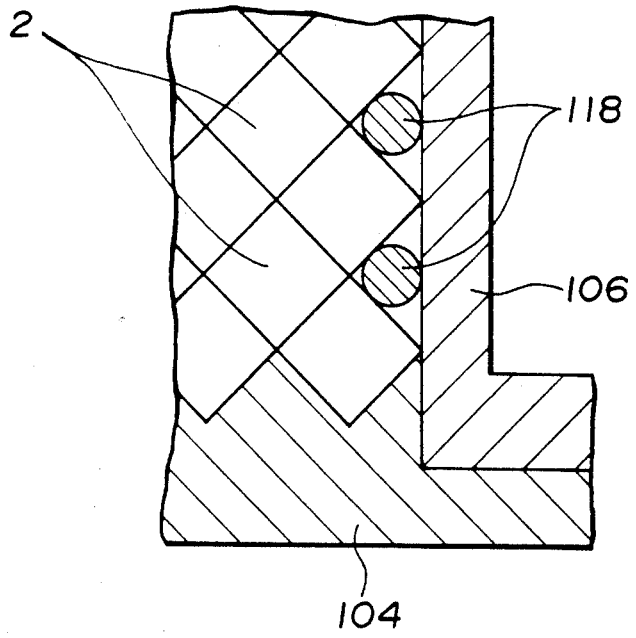

As is understood from FIGS. 37 and 38, the pins 116 or 118 which are positioned at lateral sides of the pin-made die 31 are members having a triangular cross section or circular cross section. With these members, formation of excessive gas discharging clearances is prevented.

Then, the upper wall 112 is fixed to the side walls 106 and 108 by bolts 114. With this, the pin-made die 31 becomes fixed in the pin piling device 50.

Figure 39:
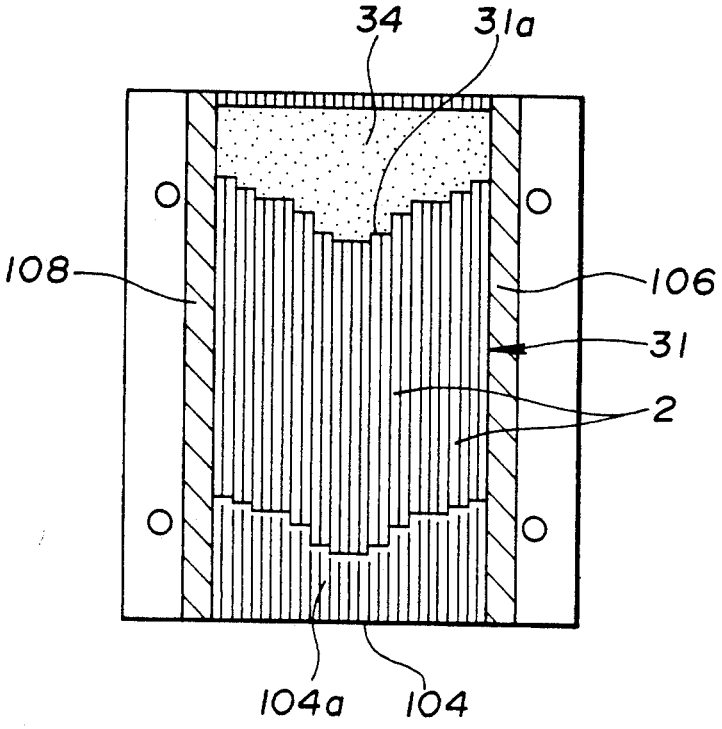
FIG. 39 is a plan view of the pin piling device of FIG. 34, showing a condition in which melted metal is being casted into a cavity defined by the piled pins.
Figure 40:
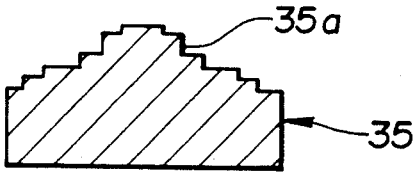
FIG. 40 is a sectional view of a casted metal die which is removed from the cavity of the piled pins of FIG. 39.

Then, as is seen from FIG. 39, the entire construction of the pin piling device 50 is pivoted so that the recessed die surface 31*a* faces upward, and then melted metal 34 is casted into the recess 31*a* of the die 31.

After being cooled, the casted metal block (viz., the casted metal die 35) is removed from the pin-made die 31. The uneven convex surface 36 (see FIG. 40) of the die 35 is smoothed to complete the die 35.

Figure 41:
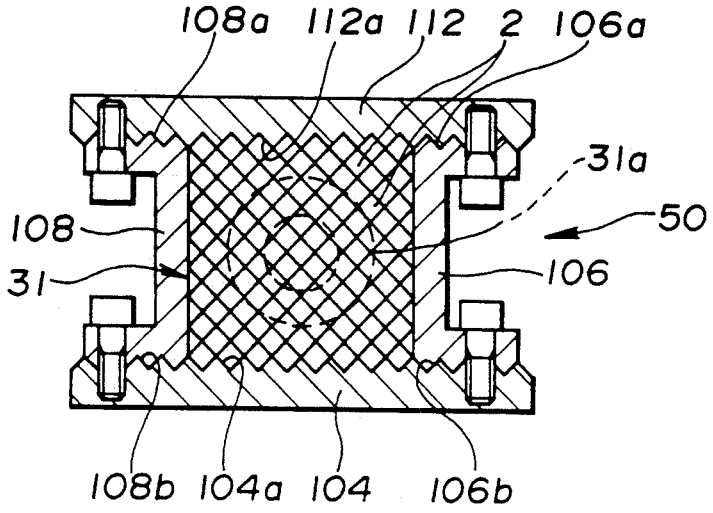
FIG. 41 is a view similar to FIG. 36, but showing a pin piling device employed in an eighth embodiment of the present invention.

Referring to FIG. 41, there is shown a pin piling device 50 employed in an eighth embodiment of the present invention. In this embodiment, each of the side walls 106 and 108 has upper and lower flanges which have parallel grooves 106*a* and 106*b* (or 108*a* and 108*b*) formed thereon. With provision of these grooves, the engagement of the side walls 106 and 108 with the horizontal base plate 104 and the detachable upper wall 112 becomes much assured.

Figure 42:
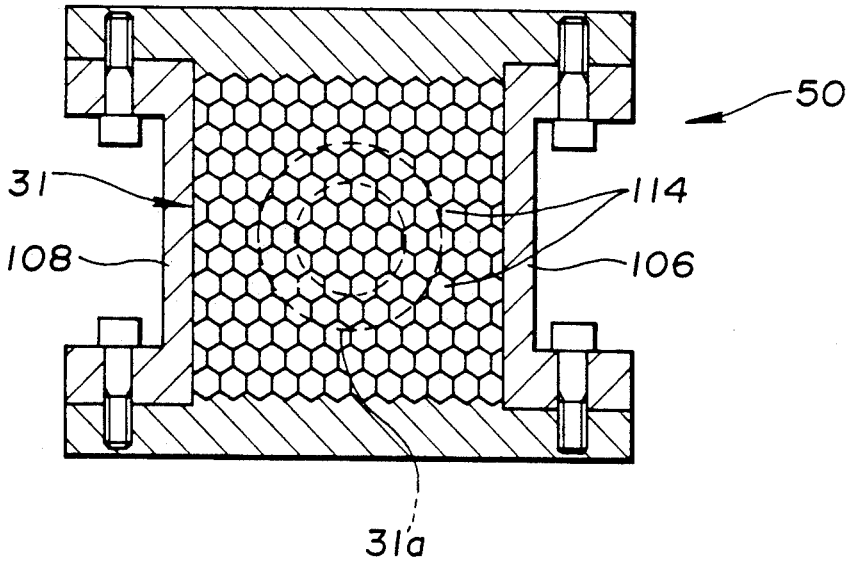
FIG. 42 is a view also similar to FIG. 36, but showing a pin piling device employed in a ninth embodiment of the present invention.

Referring to FIG. 42, there is shown a pin piling device 50 employed in a ninth embodiment of the present invention. In this embodiment, in place of the rectangular pins 2, hexagon pins 114 are used.

Although the above description is directed to methods for producing a die for deforming a sheet metal, the present invention is also applicable to methods for producing a mold for plastic molding and metal casting.

What is claimed is:

1. An apparatus for producing a variable configuration die by using a plurality of pins, comprising:

a pin storing device for storing said pins therein;

a pin piling device in which said variable configuration die is to be produced;

robot means for transferring said pins from said pin storing device to said pin piling device for making up said variable configuration die; and a computer-aided control device for controlling said robot means in such a manner is that the pins carried by the robot means are placed onto given positions of said pin piling device to cause the variable configuration die thus made of the piled pins in the pin piling device to have a layered structure, said variable configuration die thus made up having a recessed die surface which is defined by one ends of the piled pins.

2. An apparatus as claimed in claim 1, in which said computer-aided control device controls said robot means in accordance with data which represent a shape of an imaginary cast metal die which is to be produced from said variable configuration die.

3. An apparatus as claimed in claim 2, in which said data are provided by cutting said imaginary cast metal die by mutually intersected imaginary cutting planes which are perpendicular to a flat bottom surface of said imaginary die.

4. An apparatus as claimed in claim 3, in which said robot means comprises a pin handling robot which transfers said pins from said pin storing device to said pin piling device individually one after another in accordance with information signals based on said data.

5. An apparatus as claimed in claim 4, in which said pin piling device comprises:

a base plate;

a first channel structure pivotally mounted on said base plate, said channel structure being pivotal between an inclined position wherein a channel-like interior of said channel structure faces upward and a raised position wherein said interior faces obliquely upward; and a second channel structure detachably attached to said first channel structure to tightly bind the piled pins in said interior.

6. An apparatus as claimed in claim 5, in which said pin piling device further comprises stopper means by which said first channel structure is stopped at said inclined and raised positions.

7. An apparatus as claimed in claim 4, in which said pin piling device comprises:

a base plate;

a lifter table vertically movably arranged on said base plate;

a hydraulic power system for carrying out the vertical movement of said lifter table;

a pair of side walls laterally movably mounted on said base plate having said lifter table put therebetween;

hydraulic power means for effecting the lateral movement of said side walls relative to said base plate;

a detachable upper wall detachably fixed to said side walls; and control means for controlling said hydraulic power system in such a manner that each time one layer of the pins is produced on the pin piling device, the lifter table is moved down by a distance corresponding to the thickness of the pin.

8. An apparatus as claimed in claim 7, in which said detachable upper wall is connectable to said side walls by bolts.

9. An apparatus as claimed in claim 8, in which said side walls are connectable to said lifter table by bolts.

10. An apparatus as claimed in claim 4, in which said pin piling device comprises:

a base plate having parallel grooves formed thereon;

a pair of opposed side walls mounted on the grooved surface of said base plate; and a detachable upper wall having parallel grooves formed thereon, said detachable upper wall being connectable to upper ends of said side walls in such a manner that the grooved surface thereof faces the grooved surface of said base plate.

11. An apparatus as claimed in claim 10, in which each of said side wall has upper and lower flanges, said upper and lower flanges being respectively formed with parallel grooves which are mated with the grooves of said upper wall and said base plate respectively.

12. An apparatus as claimed in claim 3, in which said robot means comprises:

a pin placing device on which a predetermined number of pins are to be placed;

a pin placing robot which, receiving information signals based on said data, transfers the predetermined number of pins from said pin storing device onto said pin placing device individually one after another; and a pin handling robot which, receiving information signals based on said data, transfers the predetermined number of pins onto said pin piling device at once.

13. An apparatus as claimed in claim 12, in which said pin placing device comprises:

a base body;

a flat board member mounted on said base body; and a pair of hydraulically operated pushers arranged on said base body having said flat board member put therebetween, said pushers being so arranged that, upon energization of the hydraulic power means thereof, said pushers move toward each other to sandwich said flat board member therebetween.

14. An apparatus as claimed in claim 13, in which said flat board member has parallel grooves formed thereon.

15. An apparatus as claimed in claim 13, in which one of said pushers includes a first hydraulic cylinder and a forked hand member driven by said first hydraulic cylinder, in which the other of said pushers includes a second hydraulic cylinder and a flat hand member driven by said second hydraulic cylinder, and in which said flat board member has grooves into which the forks of said forked hand member are insertable.

16. An apparatus as claimed in claim 15, in which the hydraulic cylinder for said flat hand member has a power greater than that of the cylinder for the forked hand member.

17. An apparatus as claimed in claim 16, in is which said pin storing device comprises:

a magazine having a bottom floor inclined by a certain degree;

a pin stopper located it a downstream side of said inclined bottom floor; and a pair of pin pushers located near said pin stopper; and control means for controlling said pin stopper and said pin pushers in such a manner that the pins in said magazine are discharged therefrom one after another at given intervals.

18. An apparatus as claimed in claim 17, in which said pin piling device comprises:

a vertical base board;

two side walls, a lower wall and an upper wall, which are arranged on the vertical major surface of said base board in a manner to constitute a rectangular frame structure, said upper wall being detachable from the remaining walls;

a first press plate installed in said rectangular frame structure and horizontally movably carried by one of said side walls;

first means for changing the distance between said first press plate and said one of said side walls when actuated;

a second press plate vertically movably carried by said upper wall; and second means for changing the distance between said second press plate and said upper wall when actuated.

19. A method of producing a variable configuration die by using a plurality of identical pins, comprising by steps:

(a) storing said pins in a pin storing device and preparing a pin piling device;

(b) analyzing an imaginary metal cast die, which is to be produced by said variable configuration die, to prepare various data which represent a shape of said metal cast die;

(c) transferring said pins from said pin storing device to given positions of said pin piling device in a manner to make up the variable configuration die by the pins in accordance with information based on said data.

20. A method as claimed in claim 19, further comprising after the step (c):

(d) fastening the variable configuration die of pins to keep the shape of the die.

21. A method as claimed in claim 20, in which the transfer of said pins from said pin storing device to said pin piling device is made individually one after another.

22. A method as claimed in claim 21, in which the analyzation of the imaginary metal casted die is so made that a computer-aided image of said die is divided into a plurality of small pin parts of identical cross section by using mutually intersected imaginary cutting planes which are perpendicular to a flat bottom surface of said die image.

23. A method as claimed in claim 22, in which during the step (c), different types of pins are used in place of the identical pins so that the variable configuration die thus produced contains such different types of pins.

24. A method as claimed in claim 22, in which during the step (c), the pin piling device is intermittently moved down to facilitate the pin piling operation on the pin piling device.

25. A method as claimed in claim 19, in which said step (c) comprises:

(e) transferring a given number of pins from said pin storing device to given positions of a pin placing device individually one after another to constitute on the pin placing device one group of the pins;

(f) transferring the one group of the pins to the given positions of said pin piling device at once; and (g) repeating the steps (e) and (f) until the pins transferred to the pin piling device complete the variable configuration die.

26. A method as claimed in claim 25, further comprising after the step (g):

(h) fastening the variable configuration die to fix in place a shape of the variable configuration die.

27. A method as claimed in claim 25, further comprising before the step (e):

(i) placing in order the pins drawn from said pin storing device.

* * * * *